US006347540B1

(12) United States Patent
De Biasi

(10) Patent No.: US 6,347,540 B1
(45) Date of Patent: Feb. 19, 2002

(54) ROBOT-ACTUATE TRANSFER ASSEMBLY

(75) Inventor: Attilio De Biasi, Bolton (CA)

(73) Assignee: DeBiasi International Limited, Mississauga (CA)

( * ) Notice: Subject to any disclaimer, the term of this patent is extended or adjusted under 35 U.S.C. 154(b) by 0 days.

(21) Appl. No.: 09/543,905

(22) Filed: Apr. 6, 2000

Related U.S. Application Data

(63) Continuation-in-part of application No. 09/281,979, filed on Mar. 31, 1999, now abandoned.

(51) Int. Cl.[7] ..... B21D 43/05

(52) U.S. Cl. ..... 72/405.16; 72/405.13; 198/621.3

(58) Field of Search ..... 72/405.16, 405.13, 72/405.09, 405.11, 405.01; 198/621.3

(56) References Cited

U.S. PATENT DOCUMENTS

| | | | | | |
|---|---|---|---|---|---|
| 5,307,666 | A | * | 5/1994 | Bianchi | 72/405.11 |
| 5,557,959 | A | * | 9/1996 | Wallis | 72/405.14 |
| 5,572,898 | A | * | 11/1996 | Horde | 72/405.16 |
| 5,586,464 | A | * | 12/1996 | Horde | 72/405.16 |

FOREIGN PATENT DOCUMENTS

| | | | | |
|---|---|---|---|---|
| DE | 2632593 | * | 3/1977 | 72/405.01 |
| GB | 530188 | * | 12/1940 | 72/405.09 |

* cited by examiner

*Primary Examiner*—Daniel C. Crane
(74) *Attorney, Agent, or Firm*—Gowling Lafleur Henderson

(57) ABSTRACT

An apparatus for transferring workpieces between successive die stations in a stamping press, including an elongated bar having a plurality of spaced workpiece engaging means for engaging workpieces at successive die stations. The apparatus comprises motive means, a drive frame member coupled to the motive means and laterally and longitudinally propelled by the motive means, cam follower means propelled by the drive frame member. Cam plate means is coupled to the bar, having a first cam slot means and a second cam slot means, wherein the first cam slot means receive the cam follower means. The cam plate means is propelled both horizontally and vertically by the cam follower means. Cam stop means is disposed in the second cam slot means to prevent the cam plate means from motion in the horizontal direction during motion in the vertical direction and to prevent the cam plate means from motion in the vertical direction during motion in the horizontal direction. Motion transmitting means is coupled to the drive frame member and disposed adjacent to the cam plate means, whereby the motion transmitting means drive the cam plate means longitudinally when propelled by the drive frame member.

27 Claims, 21 Drawing Sheets

ROBOT-ACTUATE TRANSFER ASSEMBLY

This application is a continuation-in-part of application Ser. No. 09/281,979, filed Mar. 31, 1999, now abandoned.

FIELD OF THE INVENTION

This invention relates to the field of transfer assemblies which are used to transfer workpieces through a plurality of workstations. More particularly, it relates to transfer assemblies used in progressive die type punch presses.

BACKGROUND OF THE INVENTION

Workpiece transfer assemblies used in progressive die type punch presses are well known in the prior art. Despite their long history of use, many, if not all, of the prior art transfer assemblies are difficult to adapt to use with different die configurations, because of the complex assemblage of mechanical parts associated therewith.

HMS Products Co. has developed a three-dimensional transfer system ("TriAxis Transfer Models 4 and 6") which comprises features to facilitate adaption to different die geometries. In particular, HMS' transfer system includes an adjustable cam for varying the distances travelled by associated workpiece engaging means. However, HMS' transfer system requires two separate motive means to effect all three advancing/returning, clamping/unclamping and lifting/lowering operations. A first motive means, namely the press ram, effects both clamping/unclamping and lifting/lowering, while a second motive means effects only advancing/returning. By requiring two separate motive means, synchronization considerations are introduced. Further, with respect to the clamping/unclamping and lifting/lowering, HMS' transfer system performs these operations using torque transmitted through cams, levers and rods operatively connected to the press ram. Such assembly of parts introduces manufacturing complexity and additional maintenance considerations. Further, despite other aspects, as were described above, such assembly still introduces difficulties when attempting to adapt HMS' transfer process to different die configurations.

SUMMARY OF THE INVENTION

In order to provide an improved transfer apparatus for simultaneously forming/shaping one or more workpieces at a station and for transferring such workpieces from such station to another station, or to a collecting site, the present invention comprises, in one of its broad aspects, an apparatus for transferring workpieces between successive die stations in a stamping press, including an elongated bar having a plurality of spaced workpiece engaging means for engaging workpieces at successive die stations, comprising motive means. A drive frame member is coupled to the motive means and laterally and longitudinally propelled by the motive means. Cam follower means are provided and propelled by the drive frame member. Cam plate means is coupled to the bar, having a first cam slot means and a second cam slot means. The first cam slot means receives the cam follower means, whereby the cam plate means is propelled both horizontally and vertically by the cam follower means. Cam stop means are disposed in the second cam slot means to prevent the cam plate means from motion in the horizontal direction during motion in the vertical direction and to prevent the cam plate means from motion in the vertical direction during motion in the horizontal direction. Motion transmitting means are coupled to the drive shaft and disposed adjacent to the cam plate means. The motion transmitting means drive the cam plate means longitudinally when propelled by the drive frame member.

According to another aspect of the present invention, an apparatus for transferring workpieces between successive die stations in a stamping press, including an elongated bar having a plurality of spaced apart workpiece engaging means for engaging workpieces at successive die stations is provided, comprising motive means, a drive frame member coupled to the motive means and laterally and longitudinally propelled by the motive means, a first cam follower and a second cam follower, each propelled by the drive frame member, a first cam plate and a second cam plate, each of the cam plates coupled to the bar in spaced apart relationship and having a first cam slot means and a second cam slot means, the first cam slot means of the first cam plate receiving the first cam follower for driving the first cam plate horizontally and vertically with respect to the die stations and the first cam slot means of the second cam plate receiving the second cam follower for driving the second cam plate horizontally and vertically with respect to the die stations, a first cam stop and a second cam stop, the first cam stop disposed in the second cam slot of the first cam plate and the second cam stop disposed in the second slot of the second cam plate, for preventing each of the first cam plate and the second cam plate from motion in the horizontal direction during motion in the vertical direction and for preventing the first cam plate and the second cam plate from motion in the vertical direction during motion in the horizontal direction, and a first motion transmitting plate and a second motion transmitting plate, each coupled to the drive frame member, the first motion transmitting plate disposed adjacent to an inner surface of the first cam plate and the second motion transmitting plate disposed adjacent to an inner surface of the second cam plate, for driving each of the first cam plate and the second cam plate longitudinally when propelled by the drive frame member. More particularly, the first cam slot is vertically inclined. The cam stop can further comprise a cam stop follower which is received by the second cam slot. Also, second cam slot can further include a substantially horizontal first slot portion and a substantially vertical second portion, disposed in substantially orthogonal relationship to each other, and an arcuate portion interconnecting the first and second slot portions. Preferably, the motive means is a tri-axial robot capable of movement in three planes (i.e. three directions). To provide aid in overcoming a portion of the force required to move the cam plate means vertically, assist means can also be provided. Further, in order to provide guided longitudinal movement to the cam stop, an elongated rail can be provided wherein the elongated rail slidably receive the cam stop.

In another aspect, the present invention provides an apparatus for attachment to a robot for transferring workpieces in a multi-station stamping press, including an elongated bar having a plurality of spaced apart workpiece engaging means for engaging workpieces at successive die stations, characterized in that the tool comprises a drive frame member coupled to the robot and propelled by the robot laterally of and parallel to an axis parallel to the bar, a first cam follower and a second cam follower, each propelled by the drive frame member, a first cam plate and a second cam plate, each of the cam plates coupled to the bar in spaced apart relationship and having a first cam slot means and a second cam slot means, the first cam slot means of the first cam plate receiving the first cam follower for driving the first cam plate horizontally and vertically with respect to the die stations and the first cam slot means of the second cam plate receiving the second cam follower for driving the second cam plate horizontally and vertically with respect to the die stations, a first cam stop and a second cam stop, the first cam stop disposed in the second cam slot of the first cam plate and the second cam stop disposed in the second slot of the second cam plate, for preventing each of the first cam plate and the second cam plate from motion in the horizontal direction during motion in the vertical direction and for preventing the first cam plate and the second cam plate from motion in the vertical direction during motion in the horizontal direction, and a first motion transmitting plate and a second motion transmitting plate, each coupled to the drive frame member, the first motion transmitting plate disposed adjacent to an inner surface of the first cam plate and the second motion transmitting plate disposed adjacent to an inner surface of the second cam plate, for driving each of the first cam plate and the second cam plate longitudinally when propelled by the drive frame member.

In yet another aspect, the present invention provides an apparatus for transferring workpieces between successive die stations in a stamping press, including an elongated bar having a plurality of spaced workpiece engaging means for engaging workpieces are successive die stations comprising: a lifter arm having a first arm end and a second arm end, the first arm end pivotally coupled to and propelled by motive means, the second arm end pivotally coupled to said bar, a shaft extending from the lifter arm, a guide slot having a first slot end and a second slot end, wherein the first slot end is vertically disposed above the second slot end, a cam follower connected to the shaft and adapted for travel within the guide slot, wherein such travel causes rotation of the shaft and vertical displacement of the first arm end of the lifter arm. The guide slot can further comprise a substantially horizontal slot segment extending from the first slot end, and an arcuate slot segment terminating at the second slot end and characterized by an upwardly facing concave profile, the arcuate slot segment extending from and communicating with said substantially horizontal slot segment, wherein the vertical displacement of the first arm end of the lifter arm occurs during travel of the cam follower within the arcuate slot segment. The first slot end can be disposed distally from the bar relative to the second slot end. The arcuate slot segment can be characterized by a constant radius of curvature. The apparatus can further comprise a control arm extending from the shaft, wherein the cam follower extends from the control arm, and a guide pin is engaged to the control arm during travel of the cam follower within the arcuate slot segment such that the control arm rotates about a fixed axis as the cam follower travels within the arcuate slot segment. The control arm can include a sidewall providing a horizontally orthogonal surface for continuously engaging guide pin during travel of the cam follower within the arcuate slot segment. The sidewall can be characterized by an arcuate profile having a radius of curvature substantially similar to that of the arcuate slot segment.

BRIEF DESCRIPTION OF DRAWINGS

Further advantages of the present invention will appear from the following detailed description of the invention, taken together with the following drawings in which.

DESCRIPTION OF THE PREFERRED EMBODIMENT

Referring to FIGS. 1–3 and 14, an embodiment of the transfer apparatus, generally indicated as 10, is adapted for transferring workpieces 25 progressively from one die station 11 to the next. In a preferred embodiment, the transfer apparatus 10 is adapted for operation with a ram-type press and a series of in-line die stations 11 (see FIGS. 1 and 3), wherein the workpieces 25 are progressively transferred from die station 11 to die station 11 so that a plurality of sequential forming operations may be performed on them. It will be appreciated that directional adjectives such as "longitudinal" and "lateral" are taken with reference to the direction of motion of workpieces between and through successive die stations with the lateral direction being in the direction shown in arrows "B" and longitudinal being the direction shown in arrows "A" (see FIG. 3).

Figure 3:
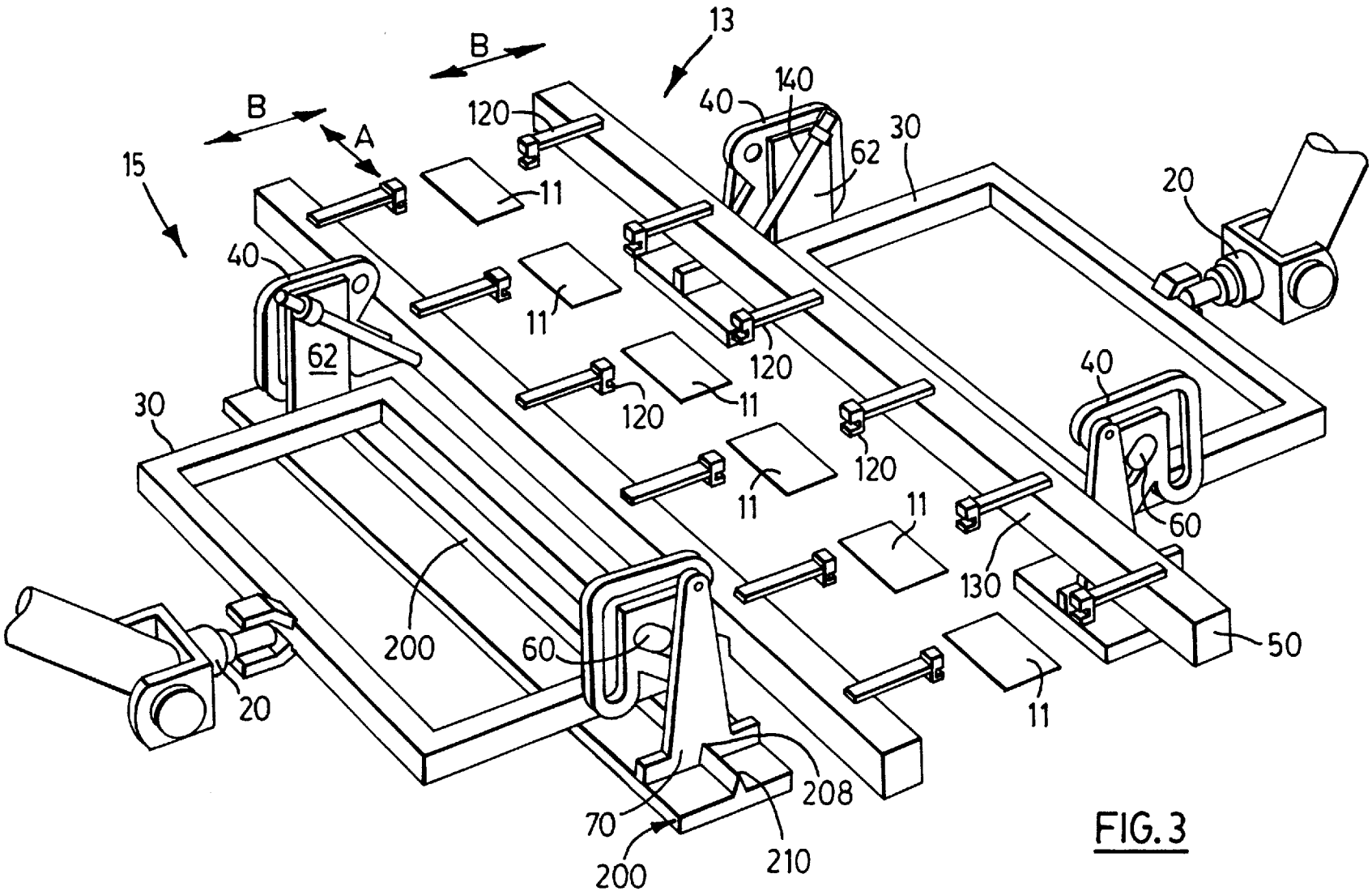
FIG. 3 is a perspective view of a further embodiment of the present invention showing dual sets of transfer apparatuses illustrated in FIG. 1 for engaging workpieces on both sides.
Figure 4:
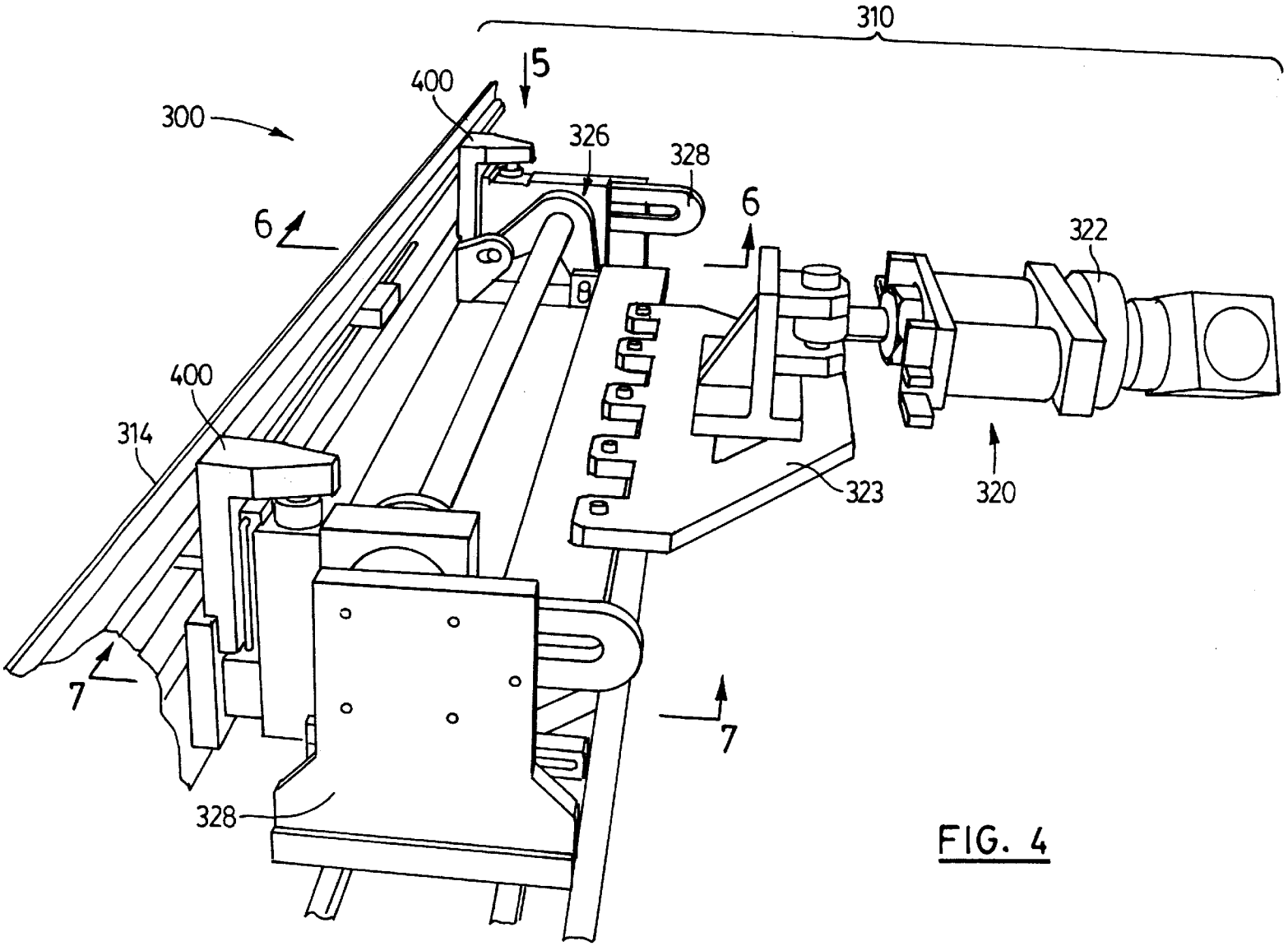
FIG. 4 is a perspective side view of a further embodiment of a transfer apparatus.

The transfer apparatus 10 includes a pair of transfer modules 13 and 15 (FIG. 3). Transfer modules 13 and 15 are mirror images of each other. Each transfer module 13 and 15 has a finger bar member 50. Each finger bar member 50 associated with each module 13 and 15 is parallel to each other.

Figure 1:
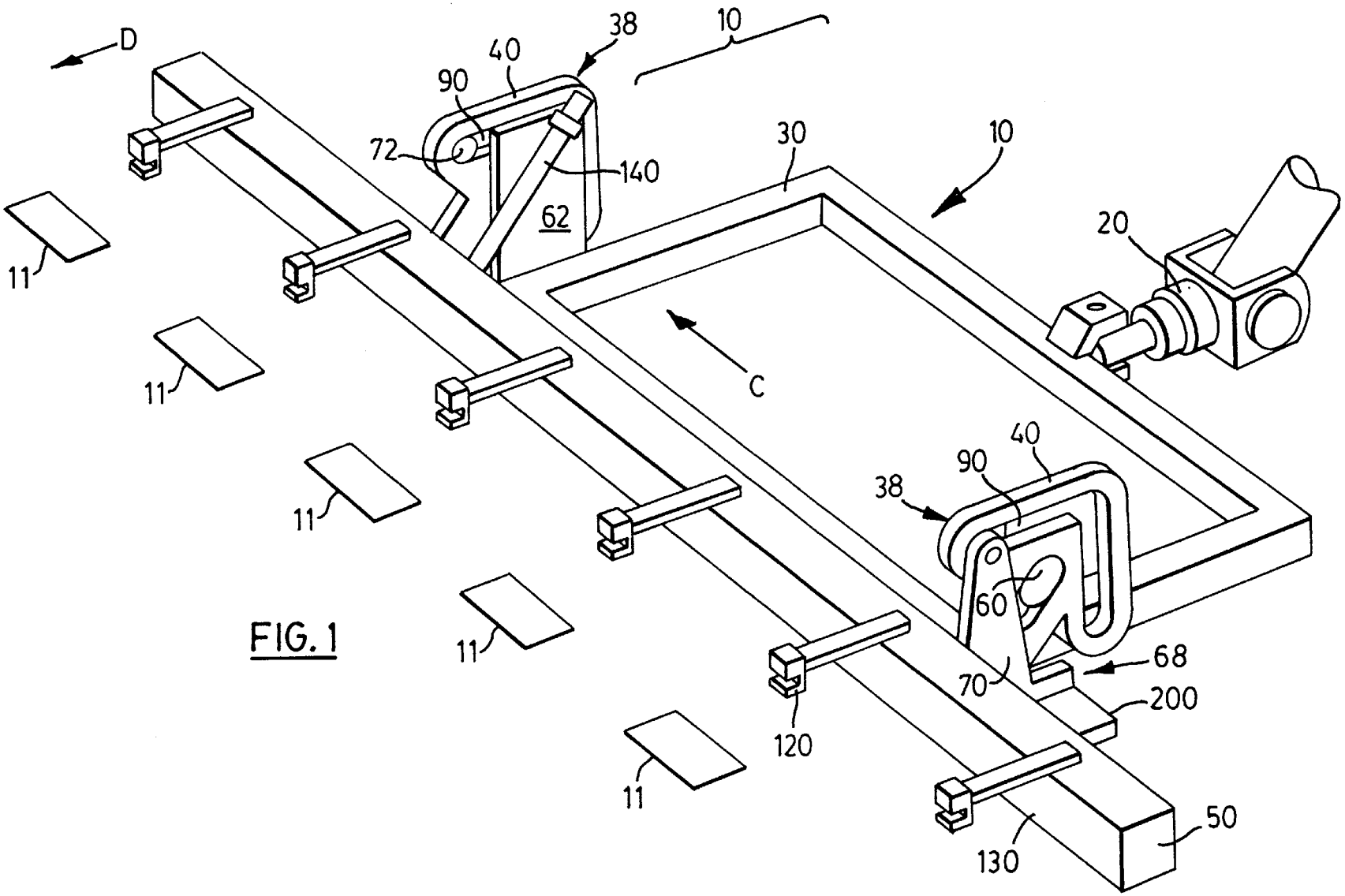
FIG. 1 is a perspective side view of one embodiment of the transfer apparatus.

Each transfer module 13 and 15 includes a single motive means 20 for effecting the necessary transfer operations. The motive means 20 is adapted to propel the drive frame member 30 in both lateral direction "B" and longitudinal direction "A". During longitudinal movement, drive frame member 30 reciprocates workpiece engaging finger bar member 50 and associated workpiece engaging means, such as component grasping fingers 120, back and forth in the direction of the length of finger bar member 50 (see FIG. 1) thereby sequentially transferring workpieces through successive die stations 11. During lateral movement, drive frame member 30 reciprocates finger bar member 50 laterally in direction of arrows "A" into and out of engagement with workpieces 25 at the die stations 11. In the preferred embodiment, and as illustrated in FIG. 1, the motive means is a tri-axial robot 20. The motive means 20 are not limited to those described herein, and other alternative motive means will now become apparent to those skilled in the art.

A pair of cam followers 60 are mounted to the drive frame member 30 (see FIG. 1). In the embodiment illustrated in FIGS. 2 A–F, cam follower 60 is a rectangular-shaped member having rounded corners mounted on and extending from the outer side and fixedly attached to the surface of plate 62 (see FIG. 1), having a geometry which cooperates with first cam slot 80 in cam plate 40 (as described below, see FIG. 2). Plate 62 extends upwardly from drive frame member 30. Through cam follower 60, drive frame member 30 drives the finger bar member 50 in a horizontal (lateral) direction into and out of a workpiece engagement position (clamping/unclamping), and also lift and lower the finger bar member 50 in a vertical direction in relation to the die station 11. Such motion is facilitated by a pair of finger bar modules 38 which are mounted to finger bar member 50. Each finger bar module 38 includes a cam plate 40, for transferring motion from drive frame member 30 to finger bar member 50. Referring to FIGS. 2A–2F, cam follower 60 is disposed for travel within a first cam slot 80 of cam plate 40. Slot 80 is substantially linear and inclined from the horizontal and adapted to receive and facilitate travel therein of cam follower 60. Drive frame member 30 imparts movement to finger bar member 50 through engagement between cam follower 60 and cam plate 40.

A support frame 200 carries a pair of stop modules 68. Each stop module 68 is associated with a cam follower 60. Each stop module 68 includes a cam stop 70. Cam stop 70 (see FIG. 1) is provided to limit lateral movement of finger bar member 50. In the preferred embodiment, and as most clearly illustrated in FIG. 2, the cam stop 70 includes cam stop follower 72 which is received for travel within second cam slot 90 in cam plate 40. Cam stop follower 72 extends from the inner side surface of cam stop 70. The slot 90 is comprised of an inverted L-shaped slot having a substantially horizontal slot portion 100, a substantially vertical slot portion 110, and an arcuate portion 85. Arcuate portion 85 interconnects substantially horizontal slot portion 100 and vertical slot portion 110. The slot portion 100, slot portion 110, and arcuate portion 85 are further adapted for slidable engagement with the cam stop follower 72, affixed to cam stop 70, to facilitate horizontal and vertical movement of the cam plate 40 and attached finger bar member 50.

Therefore, while the cam stop follower 72 (which remains laterally stationary) is engaged in horizontal travel through slot portion 100 of slot 90, vertical motion of the finger bar member 50 is prevented, and cam follower 60 is substantially stationary within slot 80. Forces imparted by the motive means 20 in a lateral direction through the cam follower 60 urges finger bar member 50 in a lateral direction into or out of a workpiece engagement position.

As the cam stop follower 72 travels (relatively speaking) through slot portion 110 of slot 90, during movement of cam plate 40, horizontal travel of the finger bar member 50 is restricted, and cam follower 60 is free to move within slot 80. In this case, lateral forces imparted by the motive means 20 through cam follower 60 urges the bar member 50 in a vertical direction relative to the die stations 11.

Cam stop 70 is mounted by a horizontally-oriented linear bearing 210 (FIG. 3), which in turn is mounted to support frame 200. In this respect, cam stop follower 72 which is affixed to cam stop 70 provides guided linear movement to the cam plate 40 and, consequently, the finger bar member 50, in the lateral direction. Cam stop 70 is slidably engaged to linear bearing 210. In particular, cam stop 70 includes a slide 208 to conform with engagement to linear bearing 210, which in the illustrated embodiments (FIGS. 1 and 3) comprises a rail. The cam stop 70, therefore, cooperates with linear bearing 210 to facilitate longitudinal travel of cam stop 70 over linear bearing 210. As such, this arrangement permits simultaneous longitudinal movement of each of said cam stop 70 and attached finger bar member 50 along the linear bearing 210, thereby facilitating transfer of the workpieces to the next in-line die station 11 when the drive frame member 30 is moved longitudinally by the robot means 20.

Figure 2A:
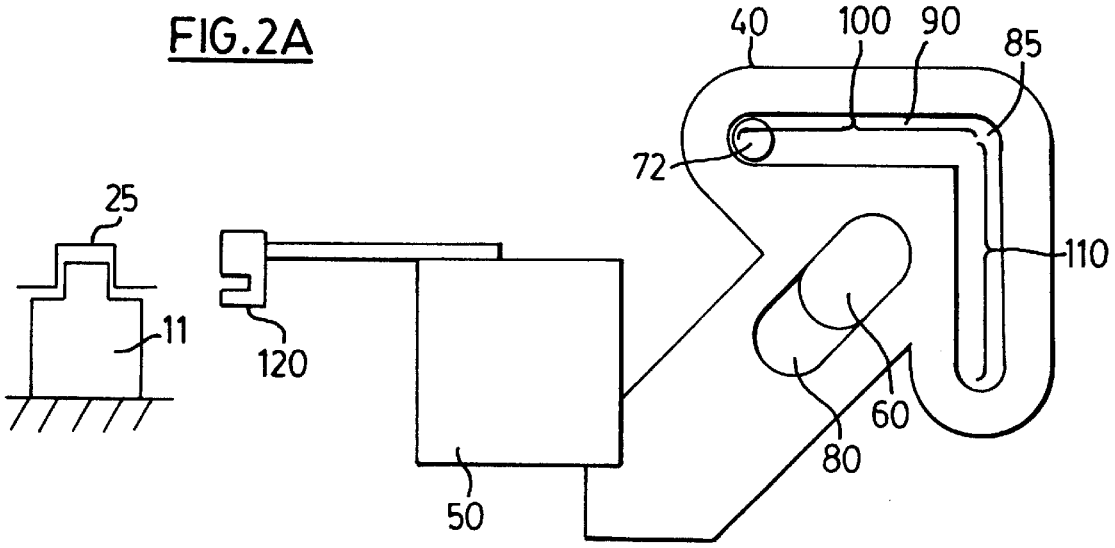
FIGS. 2A–2F are detailed cut-away views taken in the direction of arrow "C" of FIG. 1 showing the successive movement of the bar member and cam plate as it moves toward (2A) engages (2B) lifts (2C), moves to second successive station (2D), lowers (2E), and laterally retreats from (2F) the workpiece.
Figure 2B:
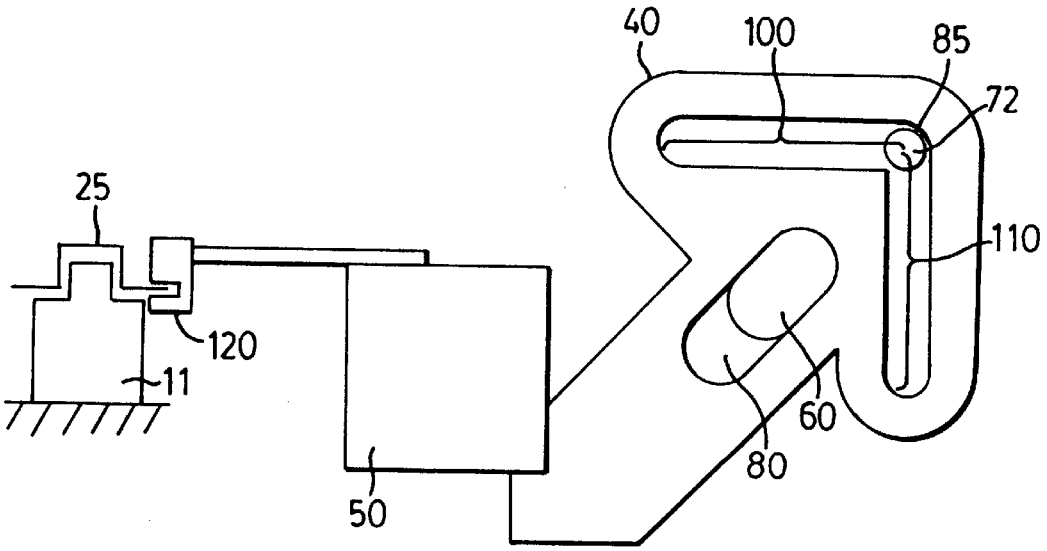
Figure 2C:
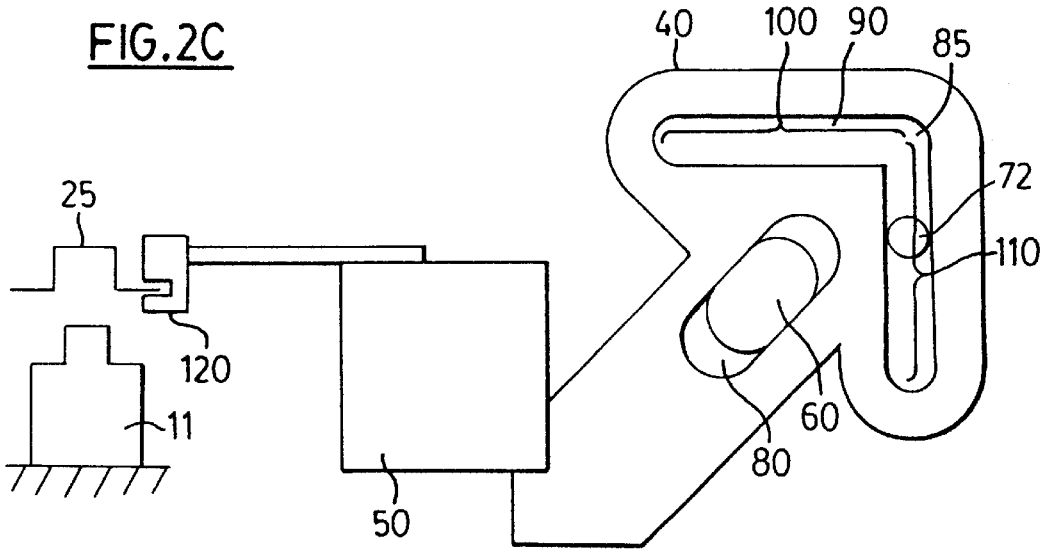

Preferably, the drive frame member 30 includes assist means 140 to aid in propelling the cam plate 40 vertically upward and thus lifting the finger bar member 50. The assist means 140 can be in the form of a gas or hydraulic cylinder, whose gas or hydraulic supply co-operates with travel of cam follower 60 through slot 80 and is activated when finger bar member 50 reaches its most laterally extended position as shown in FIG. 2C, and cam plate 40 is moving upwardly so as to raise finger bar member 50. The assist means 140 is deactivated when finger bar member 50 is lowered, i.e. when cam plate 40 moves downwardly. The assist means 140 is shown fixed at one end to finger bar member 50 and at an opposite end to an interior side of plate 62, such plate having cam follower 60 mounted thereon as described above.

In practice, it is also preferable to provide transfer apparatus 10 and associated workpiece engaging means in the form of workpiece grasping fingers 120 on each side of the die stations 11, so that the workpieces 25 are engaged on both sides thereof. In such embodiment, the opposing sets of transfer assemblies are generally mirror images of each other. Such an embodiment is illustrated in FIG. 3.

In another embodiment, the transfer apparatus 10 of the present invention may be used to transfer a plurality of workpieces 25 from a plurality of dies which each carry out a single identical stamping or molding operation on such plurality of workpieces 25, which are then all simultaneously transferred to a collecting station. In such embodiment, a plurality of workpieces 25 are transferred by finger bar member 50 to a corresponding plurality of die stations 11. A single stamping operation is carried on at such die stations 11, and thereafter the plurality of workpieces 25 are all simultaneously lifted by finger bar member 50 and apparatus 10 of the present invention, and transferred to a corresponding plurality of collecting stations (not shown) longitudinally aft of the transfer apparatus 10. Thereafter, finger bar member 50 returns to its original position to commence transfer of additional workpieces 25.

The operation of the transfer apparatus 10 of the present invention will now be described in detail, with reference to the embodiment shown in FIG. 1 and successive steps shown in FIGS. 2A–2F. Commencing with FIG. 2A, finger bar member 50 is in a laterally retracted position from the workpiece, prior to motive means 20 beginning to impart horizontal forces to the drive frame member 30 in the lateral forward direction (direction of arrow "D" in FIG. 1). The cam stop follower 72 is disposed in the horizontal slot portion 100 of slot 90 as shown in FIG. 2A. Upon motive means 20 urging finger bar member 50 forwardly in the horizontal (lateral) direction into, or toward, the workpieces 25, finger bar member 50 moves towards a workpiece engagement position. As shown in FIG. 2B, a plurality of fingers 120 mounted on finger bar member 50 engage the workpieces 25 when at the die station 11 (see FIG. 2B).

As fingers 120 engage the workpieces 25, cam plate 40 begins to rise and cam stop follower 72 begins to descend relative thereto in slidable engagement with slot portion 110 of slot 90. As the motive means 20 continues to impart horizontal forces to the drive frame member 30 in the forwardly direction, the cam follower 60 urges cam plate 40 upwardly and, therefore, finger bar member 50 in an upwardly direction, above the surface of the dies. Simultaneously, the cam follower 60 moves downwardly relative to the cam plate 40 while in slidable engagement with slot 80 (see FIG. 2C).

Figure 2D:
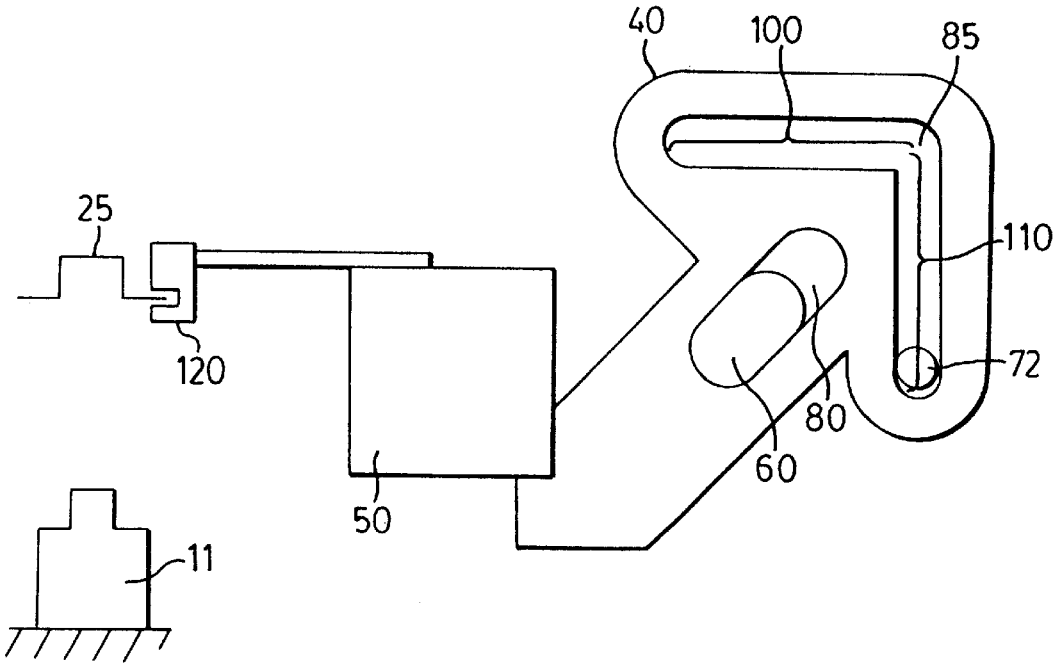
Figure 2E:
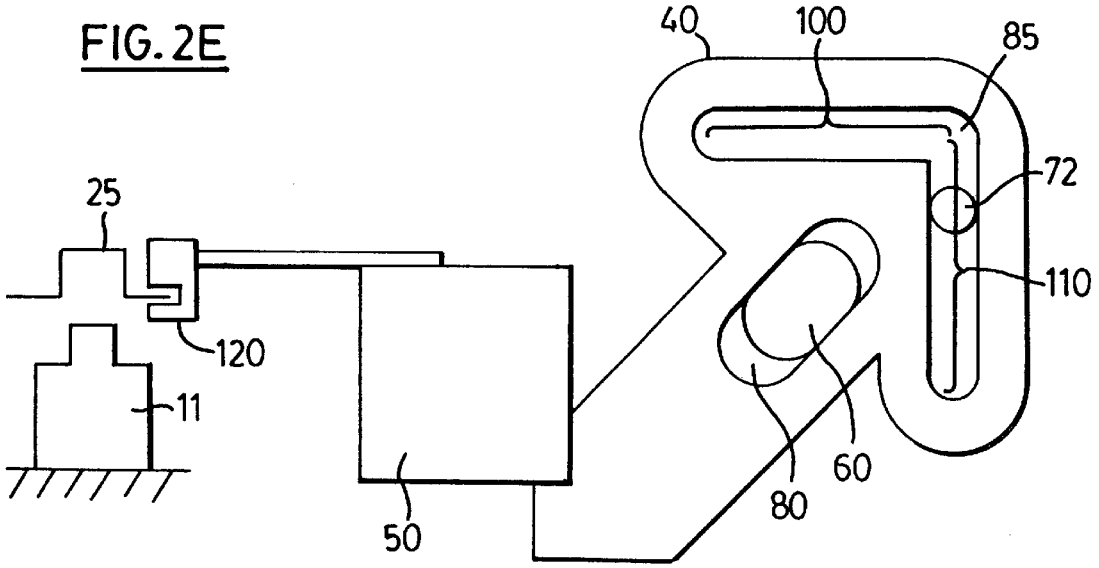
Figure 2F:
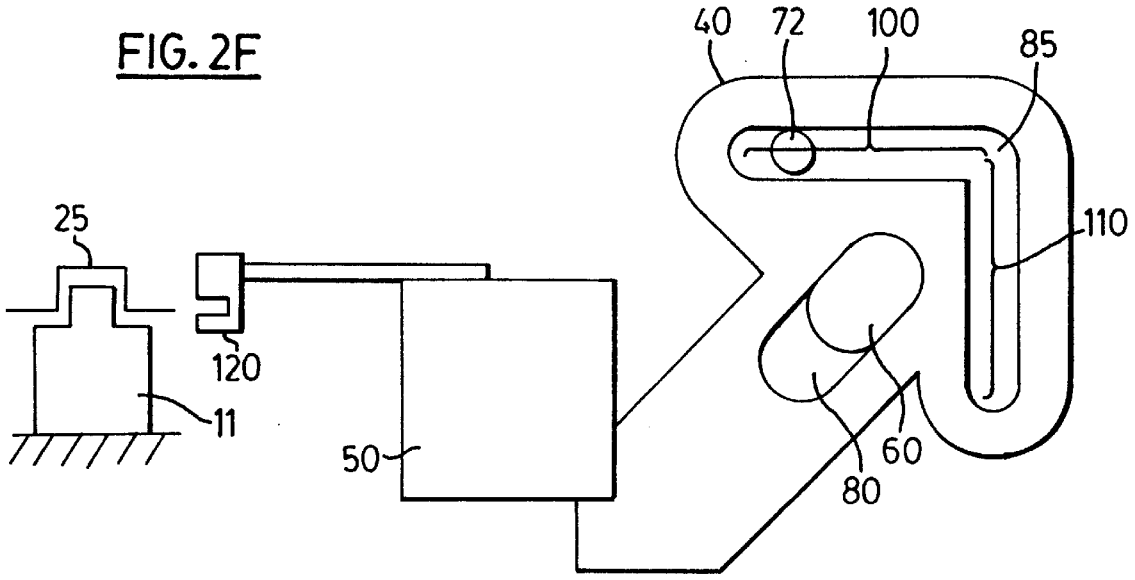

Once the workpieces 25 are lifted above the dies, the motive means 20 ceases travel in the lateral direction and commences longitudinal motion, causing the drive frame member 30, along with finger bar member 50 and the engaged workpieces to move longitudinally (direction of arrow "C" in FIG. 1) along the dies a pre-determined distance, the pre-determined distance being equal to the distance between die stations 11 in the case where the transfer apparatus 10 of the present invention is utilized to create a successive stamping operation on each workpiece (see FIG. 2D).

Once the workpieces are situate above their next respective die station 11, longitudinal movement of the motive means 20 ceases, and the motive means 20 begins imparting horizontal forces to the drive frame member 30 in a laterally rearward direction. At this time, the cam stop follower 72 continues to be disposed in slidable engagement with the slot portion 110 of slot 90. As a result, the motive means 20, through the cam follower 60 urges finger bar member 50 in a downwardly direction, lowering the workpieces onto the die station 11. Simultaneously, the cam follower 60 travels upwardly relative to the cam plate 40 while in slidable engagement with slot 80 (see FIG. 2E).

Once the workpieces are lowered onto their new die stations, the cam stop follower 72 is disposed within the slot portion 100 of slot 90, thereby preventing vertical travel of finger bar member 50. At this point, horizontal forces imparted by the motive means 20 in the rearwardly direction cause finger bar member 50 to retract from the die station 11 (see FIG. 2F). Once finger bar member 50 is in the retracted position, the motive means 20, through the cam follower 60, urges finger bar member 50 to move in a longitudinal direction back to the starting position, (see FIG. 2A) so that the fingers 120 on finger bar member 50 will be in the corresponding position of their original die stations 11.

By using a single motive means such as a robot 20 unconnected to the press ram the transfer assembly 10 can be readily adapted to different die configurations. Further, the present invention improves manufacturing efficiency by providing a further use for a robot 20 in a manufacturing environment.

FIGS. 4–13 illustrate a further embodiment of a die transfer system 300 of the present invention for transferring workpieces 302 between successive die stations 304. Die stations 304 are positioned on the lower die 305 of a stamping press having an upper die 306 coupled to a press ram 308 (not shown).

Figure 13:
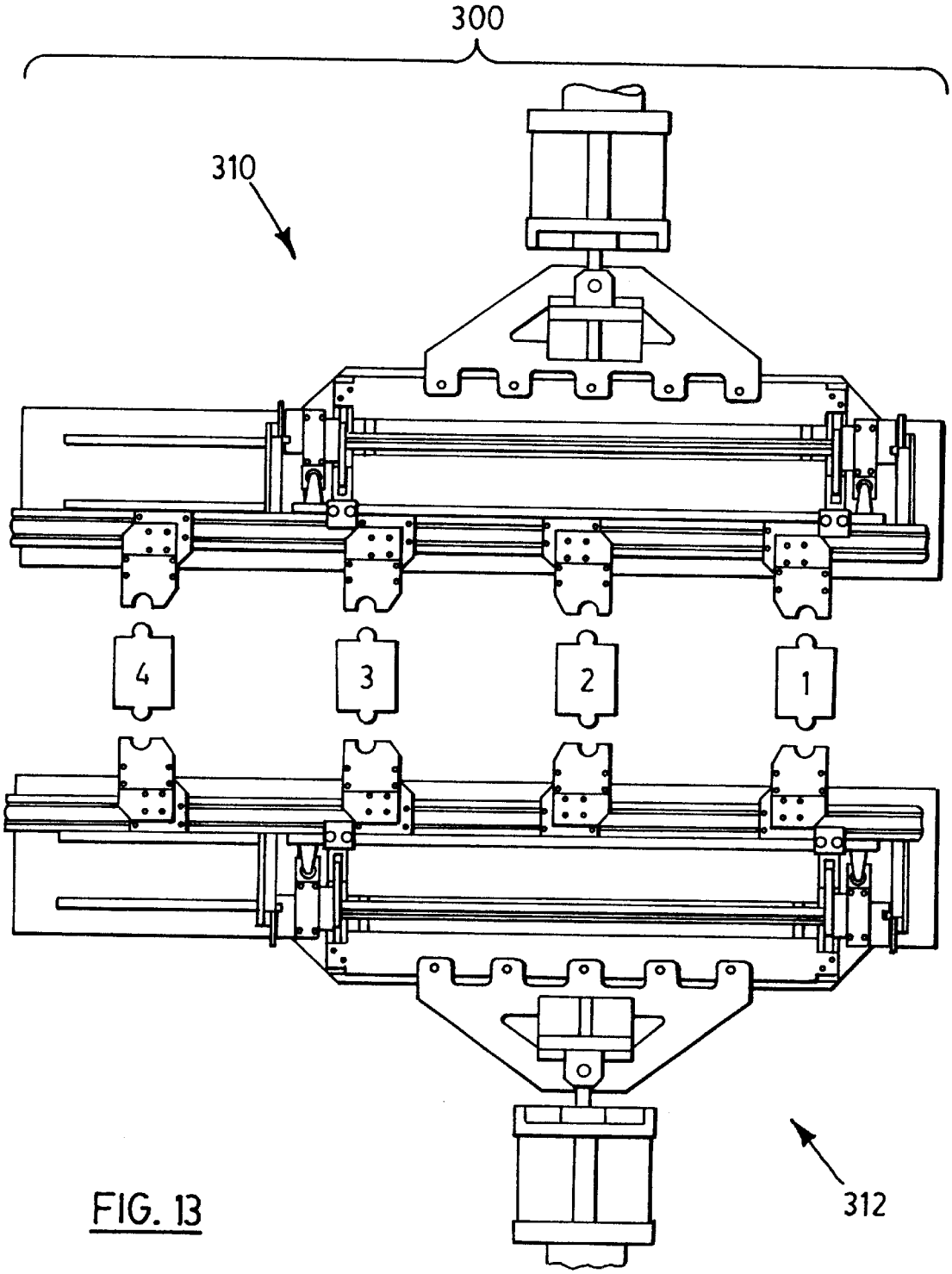
FIG. 13 is a plan view of a further embodiment of he present invention showing dual sets of transfer apparatuses illustrated in FIG. 4 for engaging workpieces on both sides.
Figure 14:
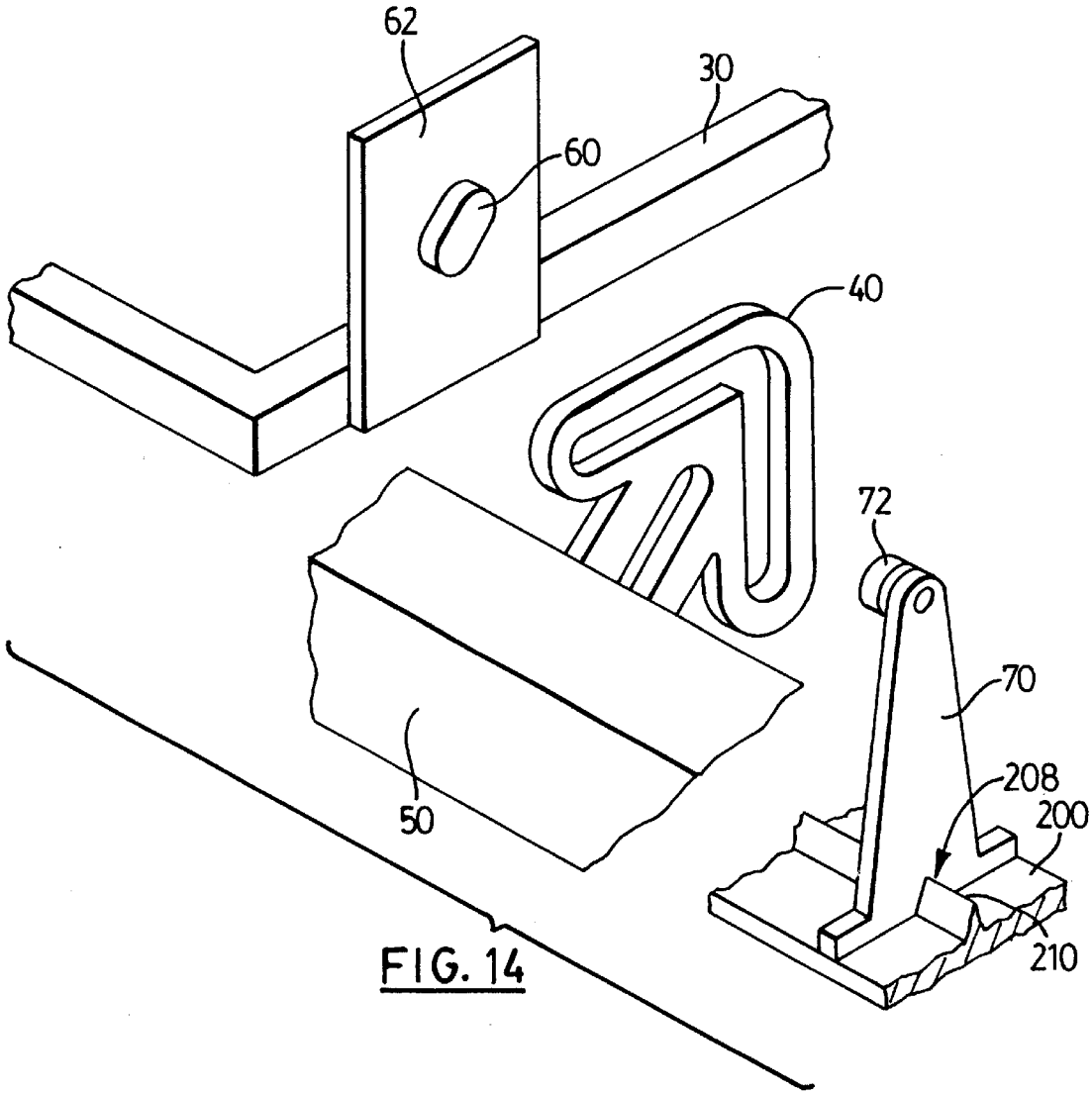
FIG. 14 is an exploded perspective view of the drive frame member, cam follower, cam plate, and cam stop of the transfer apparatus illustrated in FIG. 1.

Transfer system 300 comprises a pair of transfer modules 310 and 312 (FIG. 13). Transfer modules 310 and 312 are mirror images of each other (with only 310 being shown in FIG. 4). Each transfer module 310 and 312 includes an elongated finger bar 314. The elongated finger bars 314, associated with each transfer module 310 and 312, are parallel to each other The elongated finger bar 314 includes a plurality of longitudinally spaced fingers 316 for grasping the workpieces 302 (FIGS. 5A–C) and for transferring movement imparted by the transfer module 310 and 312 to the workpieces 302. As one necessary incident, the transfer modules 310 and 312 cause longitudinal movement of workpieces 302, in the direction denoted by directional arrow 318, between successive die stations 304, thereby permitting successive operations to be performed on workpieces 302 by pressing workpieces 302 between upper die 306 and lower die 304 using press ram 308.

Drive module 320 is connected to the finger bar 314 for imparting movement to the finger bar 314. In the embodiment illustrated in FIG. 4, the drive module 320 comprises robot motive means 322. Robot motive means 322 is movable back and forth in the lateral direction as denoted by directional arrow 324 (FIGS. 5A–C), and is further movable back and forth in the longitudinal direction as denoted by directional arrow 318. As such, robot motive means 322 is capable of imparting forces in both the lateral and longitudinal directions for causing reciprocation of the finger bar 314 laterally into and out of engagement with the workpieces 302 at the die stations 304 and lifting of the workpieces 302 above the level of the die stations 304 (for permitting longitudinal movement of the workpieces) and for also causing reciprocation of the finger bar 314 back and forth in the longitudinal direction.

The drive module 320 is coupled to at least two finger bar modules 326 which are in turn coupled to the finger bar 314. Finger bar modules 326 are spaced from each other lengthwise of the finger bar 314. Finger bar modules 326 transfer motion from robot motive means 322 to finger bar 314, thereby effecting operations as above-described.

Guide modules 328 are further provided, and associated with each of the finger bar modules 326. Guide modules 328 provide guided movement of finger bar modules 326 and, therefore, finger bar 314. Guide module 328 further acts as a detent means for limiting movement of finger bar modules 326 and, therefore, finger bar 314.

FIGS. 6,7A–C, 8A–C, 9, 10, 11 and 12 illustrate drive module 320 and finger bar module 326 in greater detail. In the embodiment illustrated, drive module 320 includes a pusher plate 323 coupled to robot motive means 322. Pusher plate 323 extends between finger bar modules 326. Each finger bar module 326 is connected at one end to pusher plate 323 by pusher arm 330. Pusher arm 330 is supported by support frame 332 (see FIG. 7A). To facilitate motion transfer to finger bar 314, pusher arm 330 is pivotally coupled to finger bar module 326. In this respect, finger bar module 326 includes a roller bearing 334 which is received within and extends through throughbore 336 provided in pusher arm 330. Throughbore 336 is larger than roller bearing 334, thereby providing allowances for movement of roller bearing 334 during rotation of lifter arm 350 as described below.

Figure 7A:
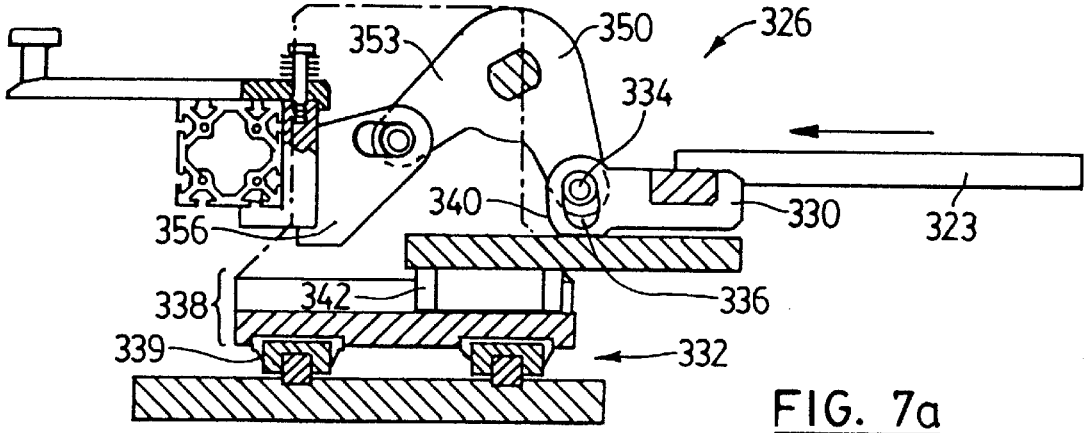
FIGS. 7A–C 7AA and 7BB are detailed cut-away side elevation views taken along the direction of lines 6—6 of FIG. 4 showing the successive movement of the bar member and the lifter arm as the bar member moves towards (7A and 7A–A), engages (7B), and lifts (7B–B and 7C) a workpiece.
Figure 7A:
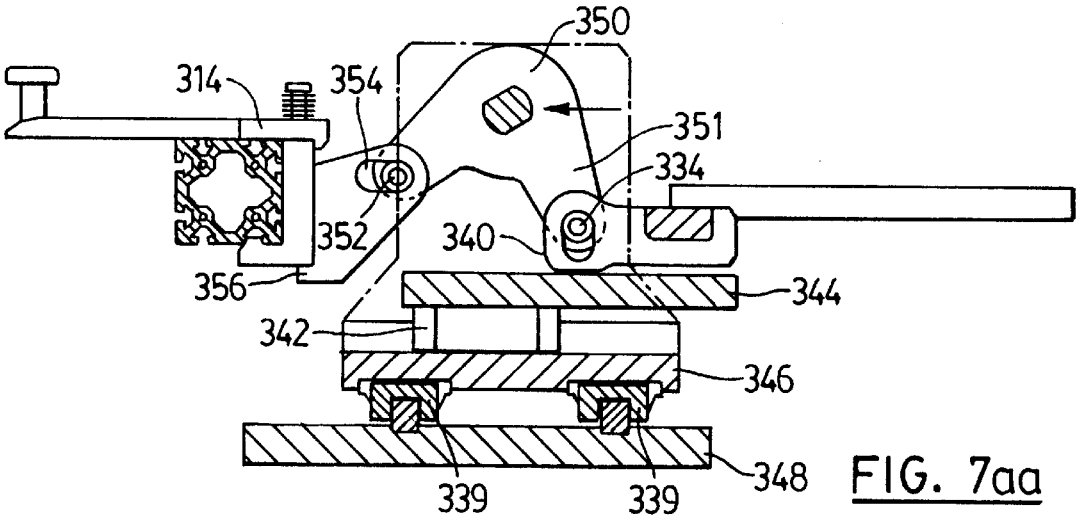

Pusher arm 330 is further mounted on a first horizontally oriented linear bearing 338 which extends in the lateral direction, and a second horizontally oriented linear bearing 339 which extends in the longitudinal direction (see FIG. 7A). Pusher arm 330 is free to move horizontally along first horizontally oriented linear bearing 338 in a lateral direction. Further, pusher arm 330 is free to move horizontally along second horizontally oriented linear bearing 339 in the longitudinal direction.

Figure 7B:
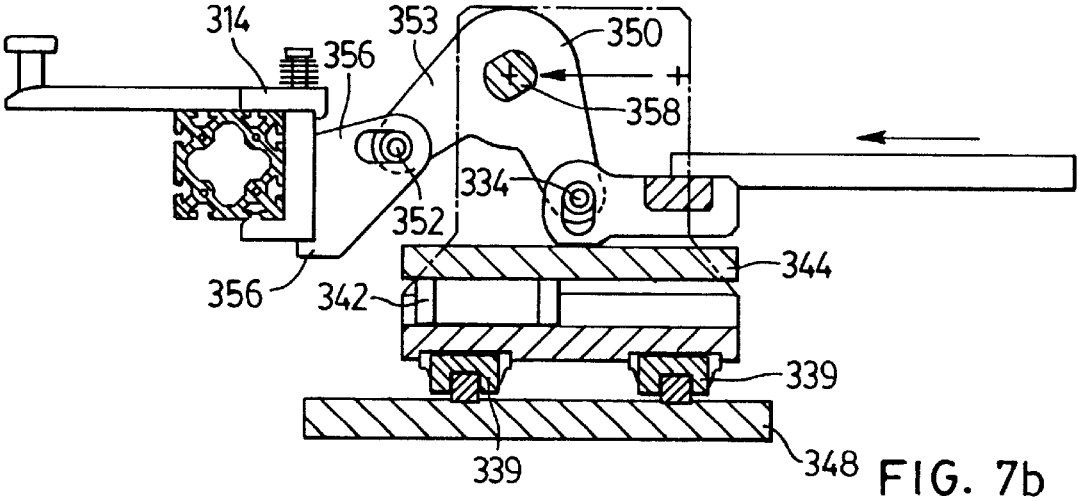
Figure 7B:
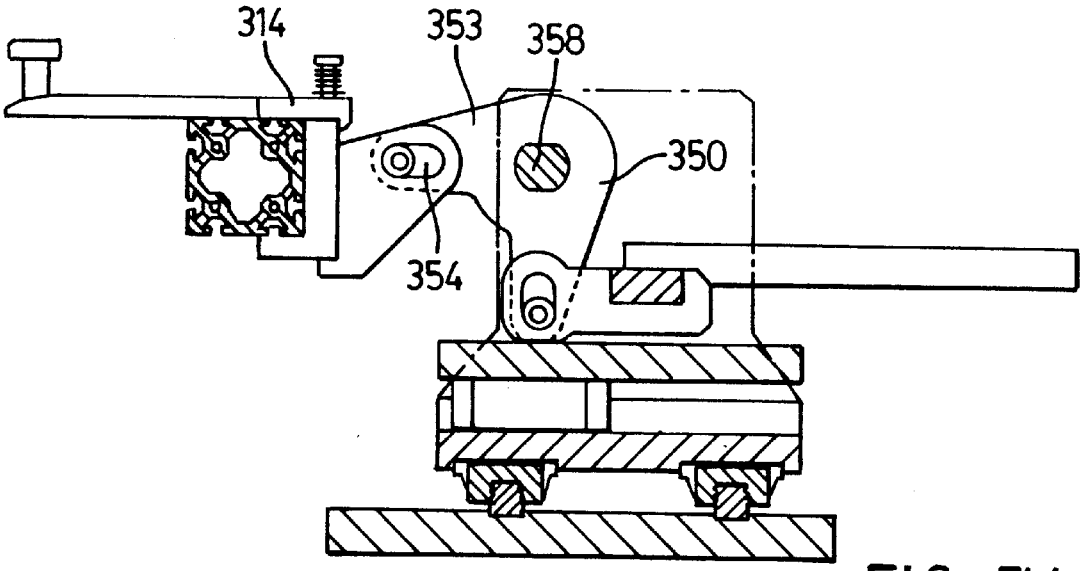
Figure 7C:
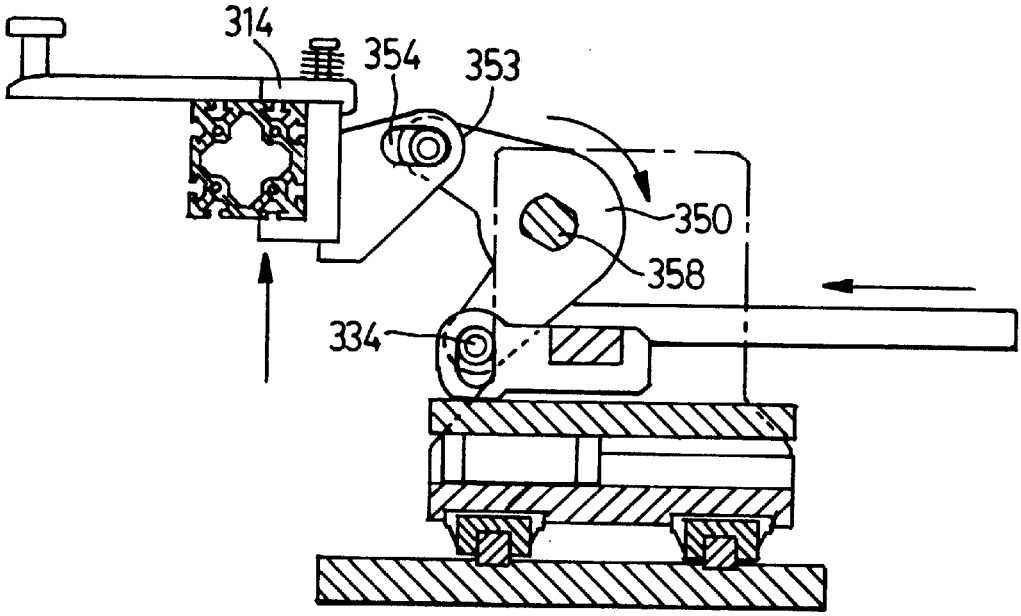

In the embodiment illustrated in FIGS. 7A–C, first horizontally oriented linear bearing 338 comprises first and second linear bearings 340 and 342. Pusher arm 330 is directly mounted for movement along first linear bearing 340, which is in turn mounted to first support frame member 344. First support frame member 344 is mounted for movement along second linear bearing 342, which is in turn mounted on second support frame member 346. Second support frame member 346 is mounted on second horizontally oriented linear bearing 339, which is in turn mounted to third support frame member 348. Support frame members 344, 346, and 348, in concert, comprise support frame 332. By having two linear bearings 340 and 342 to facilitate travel of pusher arm 330 in the lateral direction, first horizontally oriented linear bearing 338 is made more compact in size which, therefore, reduces the width required for mounting a horizontally oriented linear bearing on support frame member 348. In the embodiment illustrated in FIGS. 7A–C, each of linear bearings 340 and 342 and second horizontally oriented linear bearing 339 comprises a ball slide slideable over a rail.

Finger bar module 326 further comprises a lifter arm 350 (FIGS. 7A–C) for transforming horizontal motion of pusher arm 330 into horizontal and vertical motion of finger bar 314. In this respect, lifter arm 350 is connected at first end 351, remote from finger bar 314, to roller bearing 334 and, as such, is pivotally coupled to pusher arm 330, as above described. Further, lifter arm 350 is pivotally coupled at second end 353 to finger bar 314. In this respect, lifter arm 350 is connected at an opposite end to roller bearing 352, such roller bearing 352 being received within and extending through throughbore 354 formed in bracket 356 extending rearwardly from finger bar 314. Throughbore 354 is larger than roller bearing 352, thereby providing allowances for movement of roller bearing 352 during rotation of lifter arm 350 as described below.

Figure 8A:
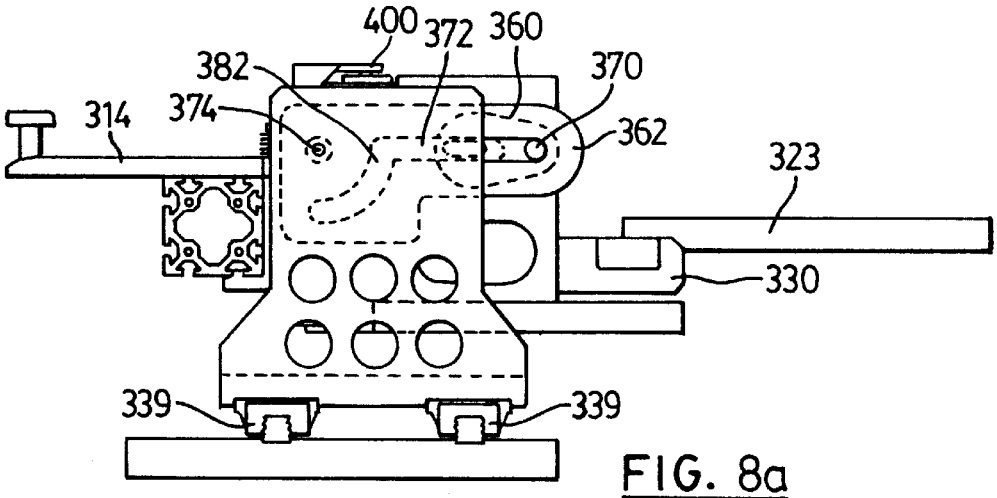
FIGS. 8A–C 8AA and 8BB are detailed cut-away side elevation views taken at lines 7—7 of FIG. 4 and FIG. 6 showing the successive movement of the cam follower within the guide slot as the finger bar moves toward (8A and 8A–A), engages (8B), and lifts (8B–B and 8C) an associated workpiece.
Figure 8A:
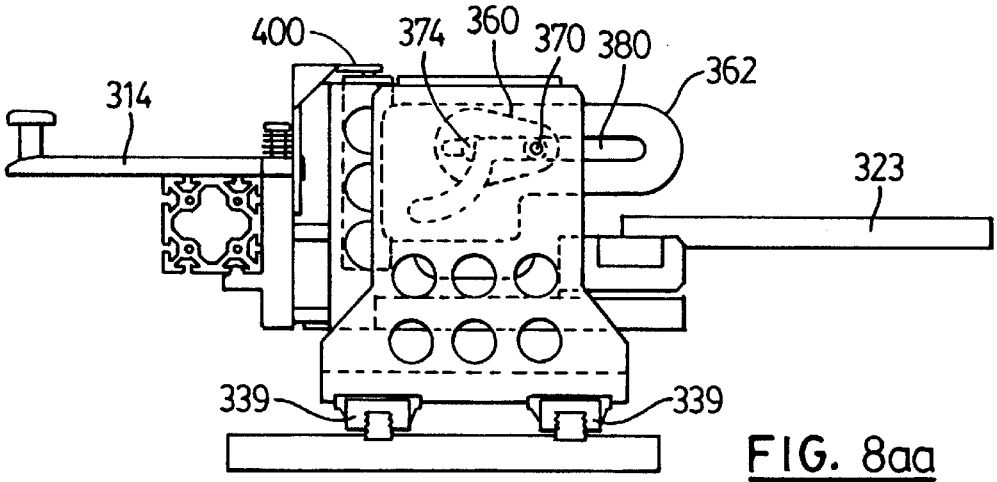
Figure 8B:
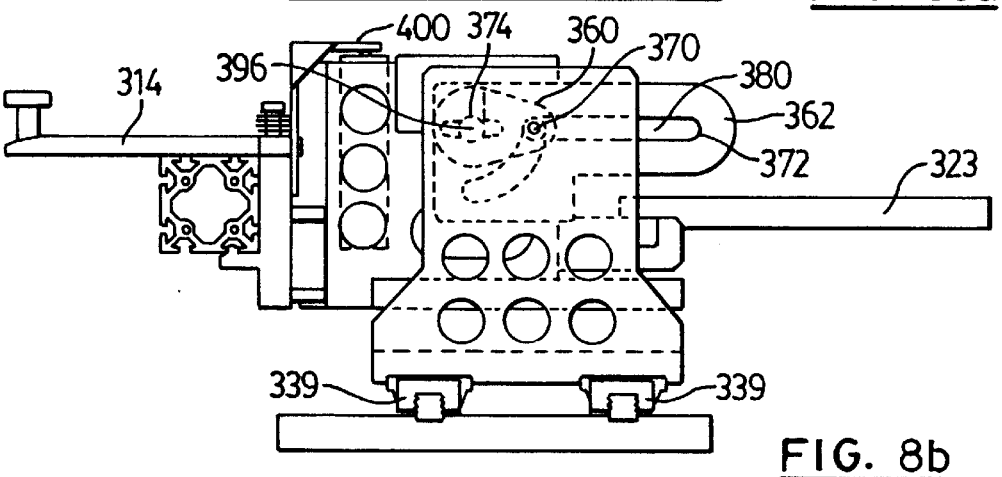
Figure 8B:
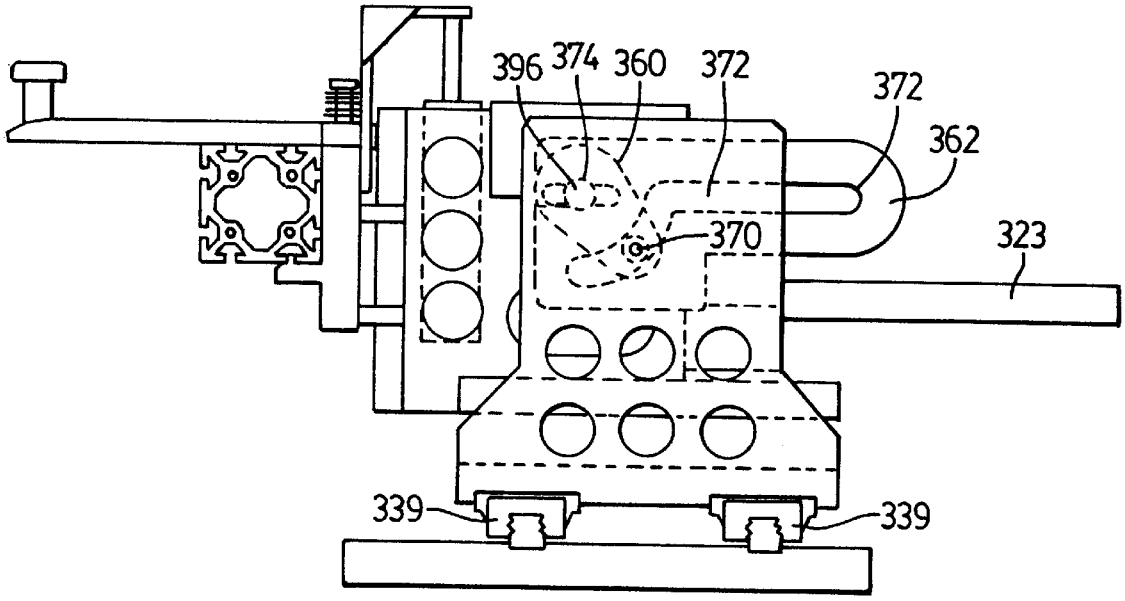
Figure 8C:
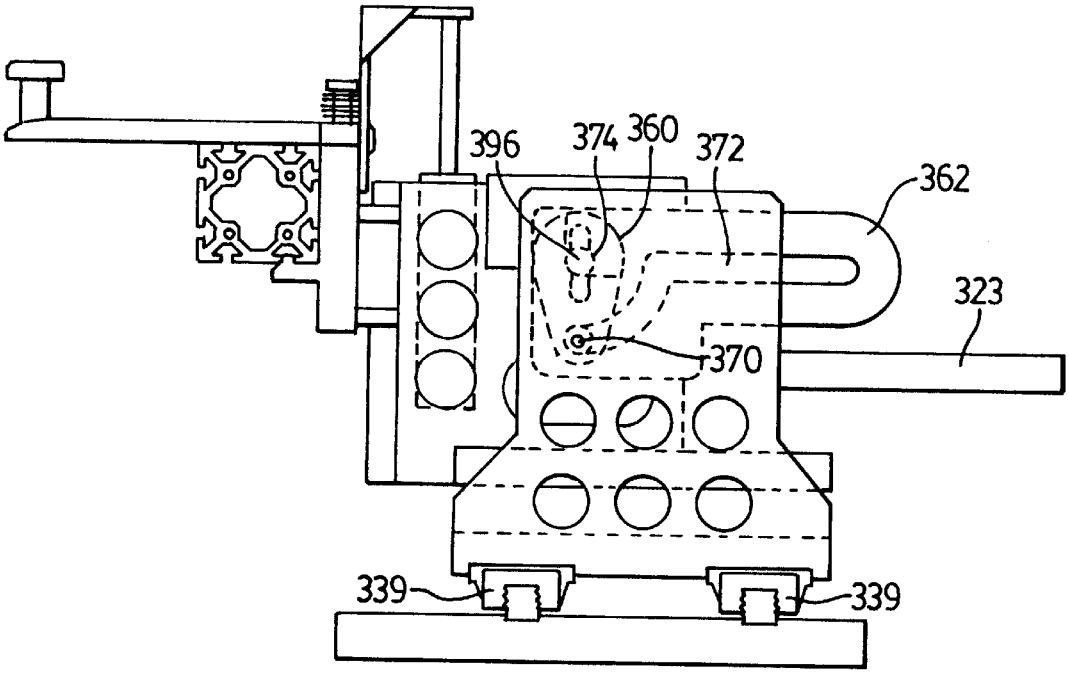
Figure 9:
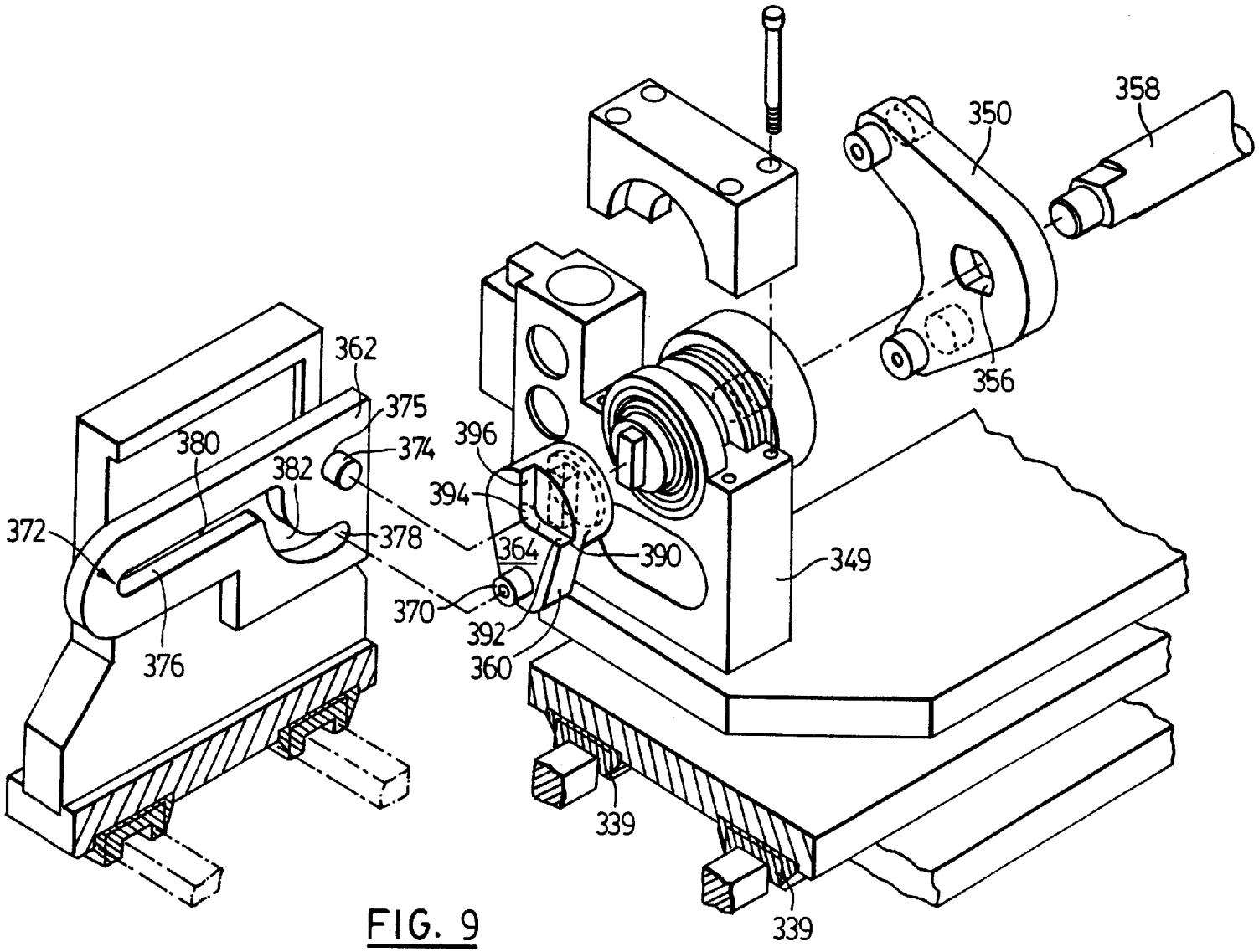
FIG. 9 is an exploded clam-shell view of a finger bar module and guide module of the transfer apparatus illustrated in FIG. 4.

Lifter arm 350 further includes throughbore 356 formed therethrough (FIG. 9). Shaft 358 extends through and is frictionally fitted within throughbore 356. As such, any rotational movement of shaft 358 is transferred to lifter arm 350. Referring to FIGS. 8A–C, 9 and 10, shaft 358 extends longitudinally between the finger bar modules 326 and, further, extends through the throughbores of the respective lifter arms 350 and externally of the lifter arms 350. Second support frame member 346 carries a bearing 349 externally of lifter arm 350 for rotatably supporting shaft 358. Shaft 358 is frictionally fitted to and carries control arm 360. Control arm 360 is disposed externally of lifter arm 350. Control arm 360 has internally facing and externally facing surfaces 364 and 366. Shaft 358 is frictionally engaged within a recess 368 (See FIGS. 9 and 10) formed within the internally facing surface 364. As such, any lateral movement of shaft 358 is transferred to control arm 360. Similarly, any rotational movement of control arm 360 is transferred to shaft 358. Shaft 358 and control arm 360 co-operate with guide module 328 to influence movement of finger bar 314 as will be described below in greater detail.

Figure 11:
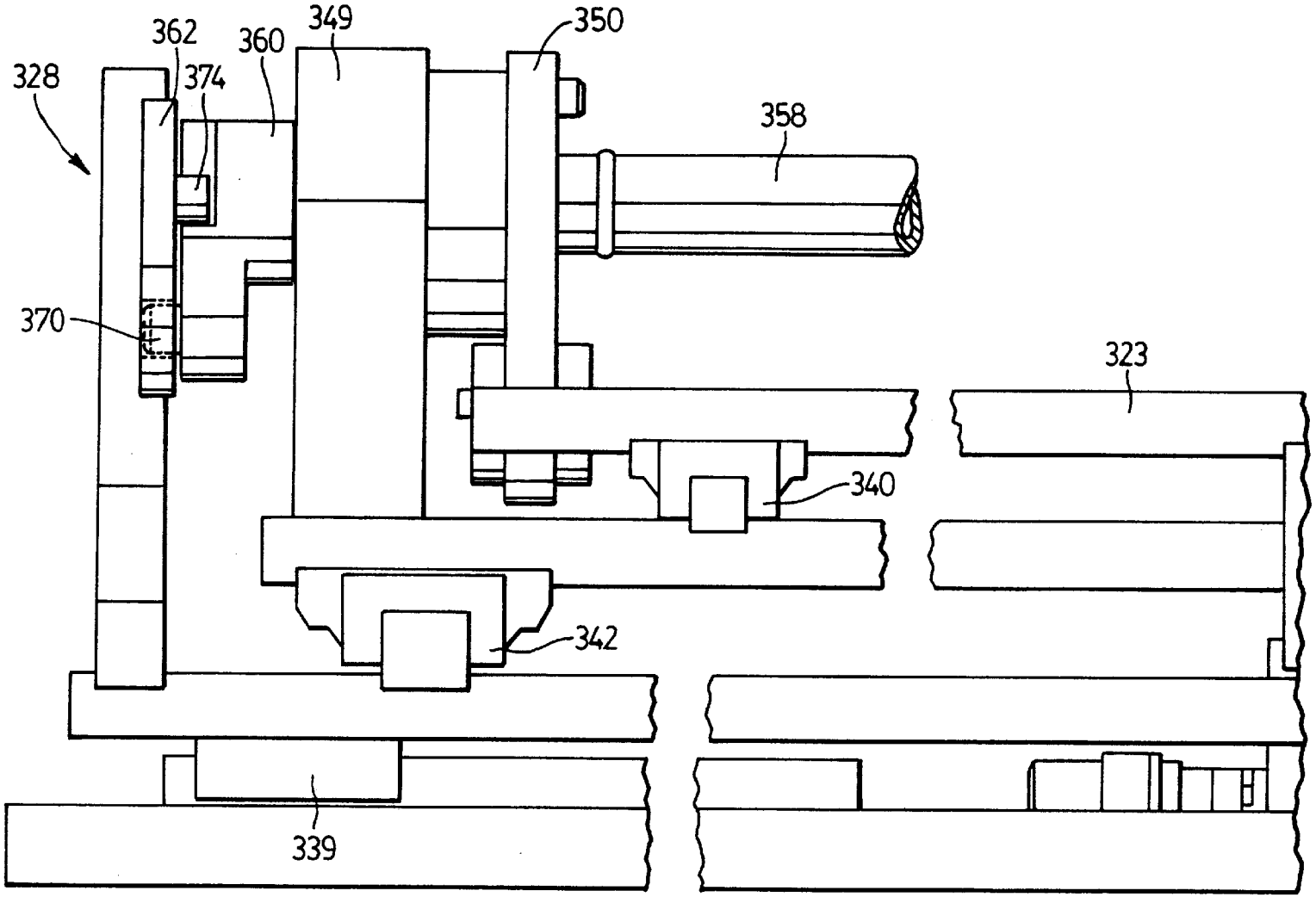
FIG. 11 is a detailed cut-away rear elevation view of the finger bar module and guide module of the transfer apparatus illustrated in FIG. 4.
Figure 12:
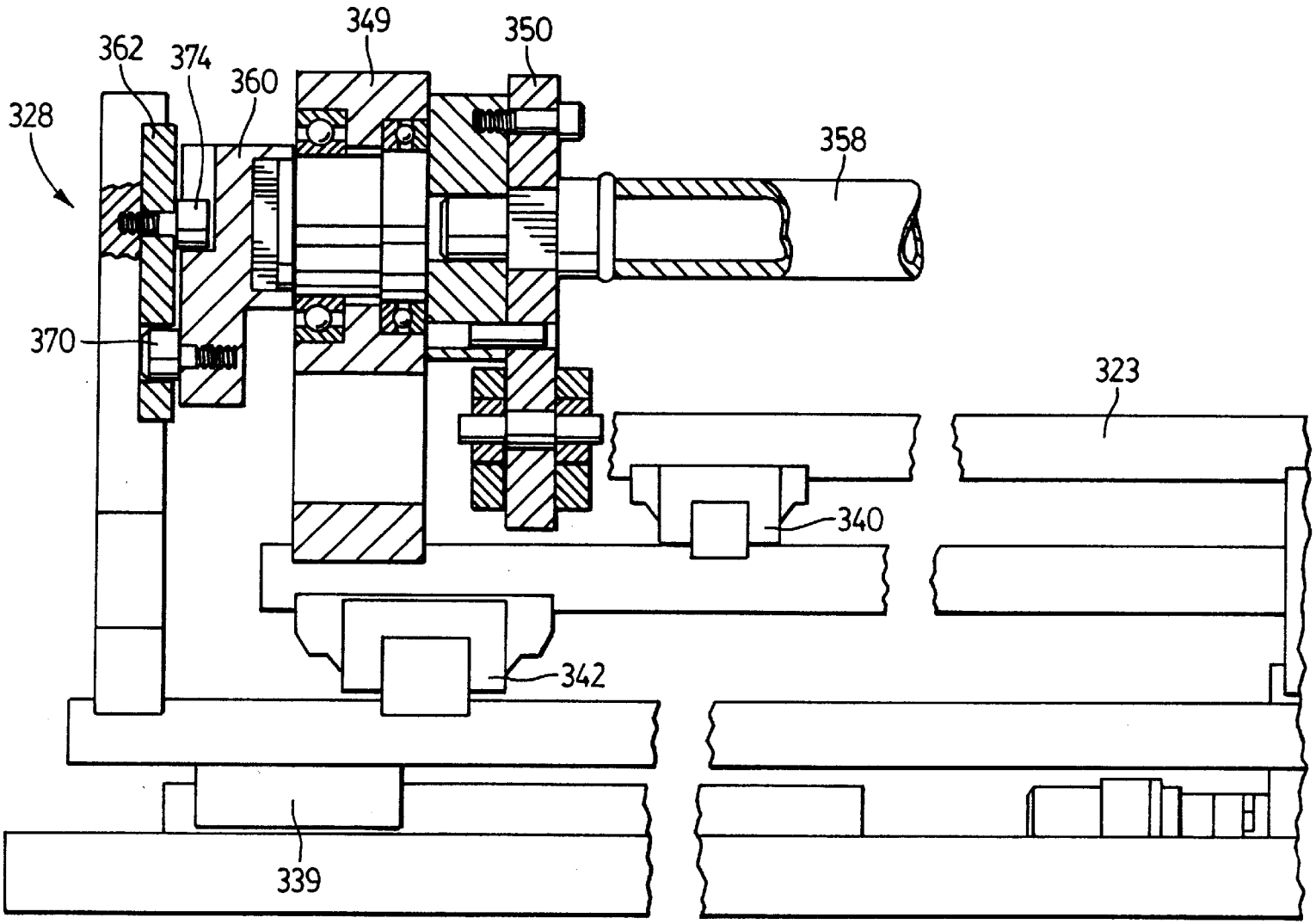
FIG. 12 is a detailed cut-away sectional rear elevation view of the finger bar module and guide module of the transfer apparatus illustrated in FIG. 11.

Guide module 328 includes a roller guide plate 362 (FIGS. 9, 11 and 12). Roller guide plate 362 is disposed externally of control arm 360. Control arm 360 is provided with first cam follower 370. In one embodiment, first cam follower 370 comprises a roller bearing. First cam follower 370 extends outwardly from outwardly facing surface 364 of control arm 360. First cam follower 370 is disposed for travel within slot 372 formed within roller guide plate 362.

As may further be clearly seen from FIG. 9, slot 372 is provided to guide lateral movement of first cam follower 370. Slot 372 has first and second ends 376 and 378. First end 376 is vertically disposed above second end 378. First end 376 is further disposed distally from finger bar 314 relative to second end 378. Slot 372 includes a first segment 380 extending from first end 376 in a horizontally linear manner towards finger bar 314. Slot 372 further includes a second segment 382 extending from and communicating with the first segment 380 and terminating at second end 378. Second segment 382 comprises an arcuate slot with an upwardly facing concave profile. First and second segments 380 and 382 form continuous slot 372. Travel of first cam follower 370 within second segment 382 of slot 372 forces rotation of control arm 360 and, therefore, rotation of shaft 358. If travel of first cam follower 370 is in a laterally forward direction, and, therefore, descending, such rotation is clockwise. Alternatively, if travel is in a laterally rearward direction, and, therefore, ascending, this rotation is counterclockwise.

Because shaft 358 is frictionally engaged to lifter arm 350, clockwise rotation of shaft 358 causes pivotal movement of lifter arm 350 such that second end 353 is displaced vertically upwards. In response, because second end 353 is pivotally coupled to finger bar 314, finger bar 314 also becomes vertically displaced in an upwardly direction. On the other hand, travel within first segment 380 does not subject first cam follower 370 or, for that matter, control arm 360 or shaft 358 to any vertical forces which could trigger rotation of control arm 360 and shaft 358. As such, vertical position of finger bar 314 remains substantially constant during travel of first cam follower 370 within first segment 380.

Roller guide plate 362 is provided with guide pin 374 to act as detent means to limit lateral movement of control arm 360. By doing so, guide pin 374 also limits lateral movement of shaft 358, lifter arm 350, and finger bar 314, by virtue of the above-described relationship between these components.

Guide pin 374 is adapted to engage control arm 360 during guided travel of first cam follower 370 within slot 372 of roller guide plate 362. In this respect, guide pin 374 is provided to act as a detent means for restricting laterally forward motion of finger bar 314. Guide pin 374 is horizontally and vertically fixed in space relative to roller guide plate 362. In the embodiment shown, a first end 375 of guide pin 374 is fixedly connected to roller guide plate 362.

Outwardly facing surface 364 of control arm 360 includes a recessed portion 384 and an elevated portion 386 (FIG. 9). Recessed portion 384 is connected to elevated portion 386 by adjoining sidewall 388. Recessed portion 384 extends rearwardly from front edge 390 and is adapted to traverse guide pin 374 during lateral motion of control arm 360, thereby not interfering with motion of control arm 360. Sidewall 388 provides a horizontally orthogonal surface for continuously engaging guide pin 374 during travel of first cam follower 370 within second slot segment 382. On the other hand, while first cam follower 370 is travelling within first slot segment 380, sidewall 388 does not offer a horizontally orthogonal surface for engaging guide pin 374. As such, guide pin 374 does not interfere with laterally forward motion of control arm 360 while first cam follower 370 is travelling within first slot segment 380.

While first cam follower 370 is travelling within first slot segment 380, control arm 360 moves in a horizontally linear manner in the lateral direction, without interference from guide pin 374. Similarly, shaft 358, lifter arm 350, and finger bar 314, all move in a horizontally linear manner in the lateral direction. On the other hand, while first cam follower 370 is travelling within second slot segment 382, shaft 358 is caused to rotate, thereby imparting vertical motion to lifter arm 350 and finger bay 314. Because of the geometry of second slot segment 382, second slot segment 382 forces first cam follower 370 to adopt either an ascending or descending motion, depending on whether pusher arm 330 is urging finger bar module 326 in a forward or rearward direction. Simultaneously, second slot segment 382 further causes rotation of control arm 360. Such rotation is transferred to shaft 358, which carries control arm 360. Because shaft 358 is frictionally fitted through lifter arm 350, rotation of shaft 353 causes vertical motion of lifter arm 350, which is immediately translated to vertical motion of finger bar 314.

During vertical motion of finger bar 314, it is desirable to ensure that there be no lateral component to that motion. In this respect, to prevent laterally forward or rearward travel of finger bar 314, it is desirable that rotation of shaft 358 occurs about a fixed axis (denoted by reference character 396 in FIGS. 8B, 8B–B, 8C) during vertical motion of finger bar 314 (which coincides with travel of first cam follower 370 within second slot segment 382). Because control arm 360 is carried by shaft 358, it is also, therefore, required that rotation of control arm 360 be maintained about this same fixed axis 396. Accordingly, as first cam follower 370 descends within second slot segment 382, it is desirable to maintain clockwise rotation of control arm 360 about axis 396.

To maintain clockwise rotation of control arm 360 about fixed axis 396 during this sequence of events, second slot segment 382 is formed with a constant radius of curvature. Further, sidewall 388 of control arm 360 is adapted to provide a horizontally orthogonal surface for continuously engaging guide pin 374 during the entire travel of first cam follower 370 within second slot segment 382.

To this end, sidewall 388 comprises a first substantially linear segment 392 joined to second substantially linear segment 394 by arcuate segment 396 (FIG. 9). In the embodiment shown, arcuate segment 396 is connected at a first end to first front edge portion 390 of control arm 360 by first sidewall segment 392, and is connected at a second end to second front edge portion 391 by second segment 394. Arcuate segment 396 provides a horizontally orthogonal surface for continuously engaging and applying horizontal forces on guide pin 374 during the entire travel of first cam follower 370 within second slot segment 382. In this respect, arcuate segment 396 presents a concave profile when first engaging and acting upon guide pin 374 as first cam follower 370 begins descending within second slot segment 382 during forward motion of pusher arm 330. Arcuate segment 396 is further characterized by a radius of curvature which is substantially similar to the radius of curvature of second slot segment 382.

To illustrate interaction between sidewall 388 and guide pin 374 during forward motion of control arm 360, while first cam follower 370 is travelling within first slot segment 380, and approaching second slot segment 382, guide pin 374 becomes slidingly engaged to first sidewall segment 392, providing substantially no opposing forces to first sidewall segment 392 as first sidewall segment 392 traverses guide pin 374. First sidewall segment 392 continues to traverse guide pin 374 until first cam follower 370 becomes disposed within second slot segment 382. As first cam follower 370 becomes disposed within second slot segment 382, guide pin 374 engages arcuate sidewall segment 396. At this point, arcuate sidewall segment 396 provides a horizontally orthogonal surface for engaging guide pin 374. Simultaneously, the axis of rotation of control arm 360 becomes fixed. As first cam follower 370 begins descending within second slot segment 382, control arm 360 is forced to rotate in a clockwise direction. Arcuate sidewall segment 396 rotates within control arm 360 while continuing to provide a horizontally orthogonal surface which maintains continuous contact with guide pin 374. As such, guide pin 374 substantially fixes and prevents movement of the axis of rotation of control arm 360 while first cam follower 370 is travelling within second slot segment 382. In order to maintain contact with guide pin 374 in this manner, arcuate sidewall segment 396 is characterized by a radius of curvature which is substantially similar to the radius of curvature of second slot segment 382.

To facilitate rotational movement of control arm 360 over guide pin 374, guide pin 374 includes a roller 393 for contacting sidewall 388 throughout the entire travel of first cam follower 370 within second segment 382. In the embodiment shown, roller 393 is provided on a second end 394 of guide pin 374. Because guide pin 374 is fixed at first end 375 to roller guide plate 362, roller 393 is prevented from moving horizontally and vertically relative to roller guide plate 362, but is permitted rotational movement relative to roller guide plate 362. Because such rotational movement is permitted, roller 393 acts as a roller bearing when in contact with control arm 360, thereby facilitating rotational movement of control arm 360 about shaft 358.

Figure 10:
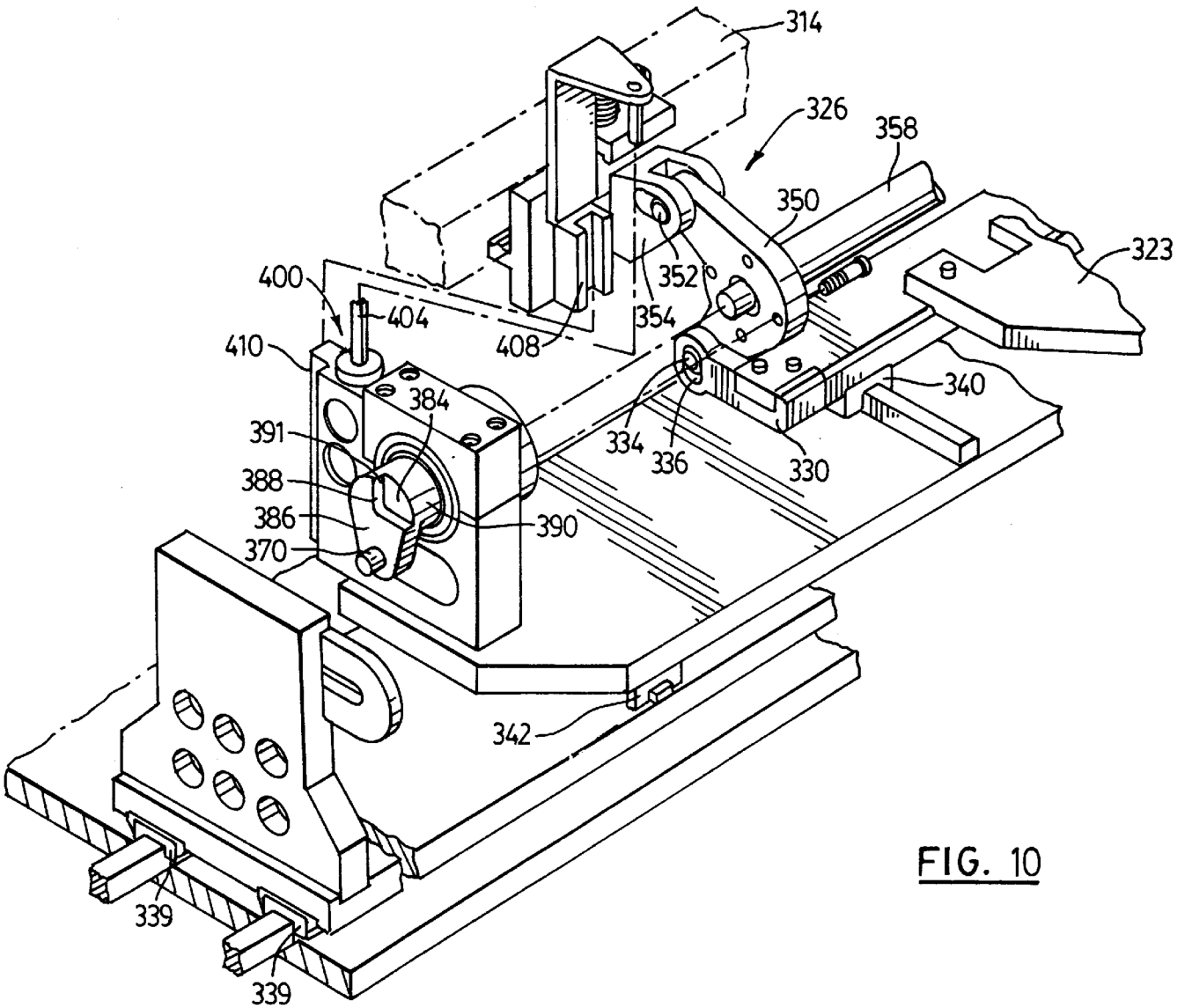
FIG. 10 is an exploded perspective view of the pusher arm, finger bar module, and finger bar of the transfer apparatus illustrated in FIG. 4.

Preferably, assist means 400 are provided on pusher arm 330 for assisting lifter arm 350 in lifting finger bar 314 (FIG. 10). The assist means 400 can be in the form of a gas or hydraulic cylinder, whose gas or hydraulic supply co-operates with travel of first cam follower 370 such that assist means 400 are activated when finger bar 314 reaches its most laterally extended position and first cam follower 370 begins travelling within second slot segment 382 upon urging by robot motive means 322 in a forwardly direction. The assist means 400 is deactivated when finger bar 314 is being lowered. In the embodiment, illustrated in FIGS. 8A–C, 9 and 10, assist means 400 comprises a housing 402 with an extendible air cylinder 404 mounted to a first linear bearing 340. Air cylinder 404 is oriented to move upwardly and downwardly in a horizontal plane. Air cylinder 404, thereby facilitating vertical movement of finger bar 314. Finger bar 314 is further mounted on a ball slide 408 and thereby slidable over rail 410 in a vertical direction and in a horizontal plane. Rail 410 is mounted to the exterior of housing 402.

Figure 5A:
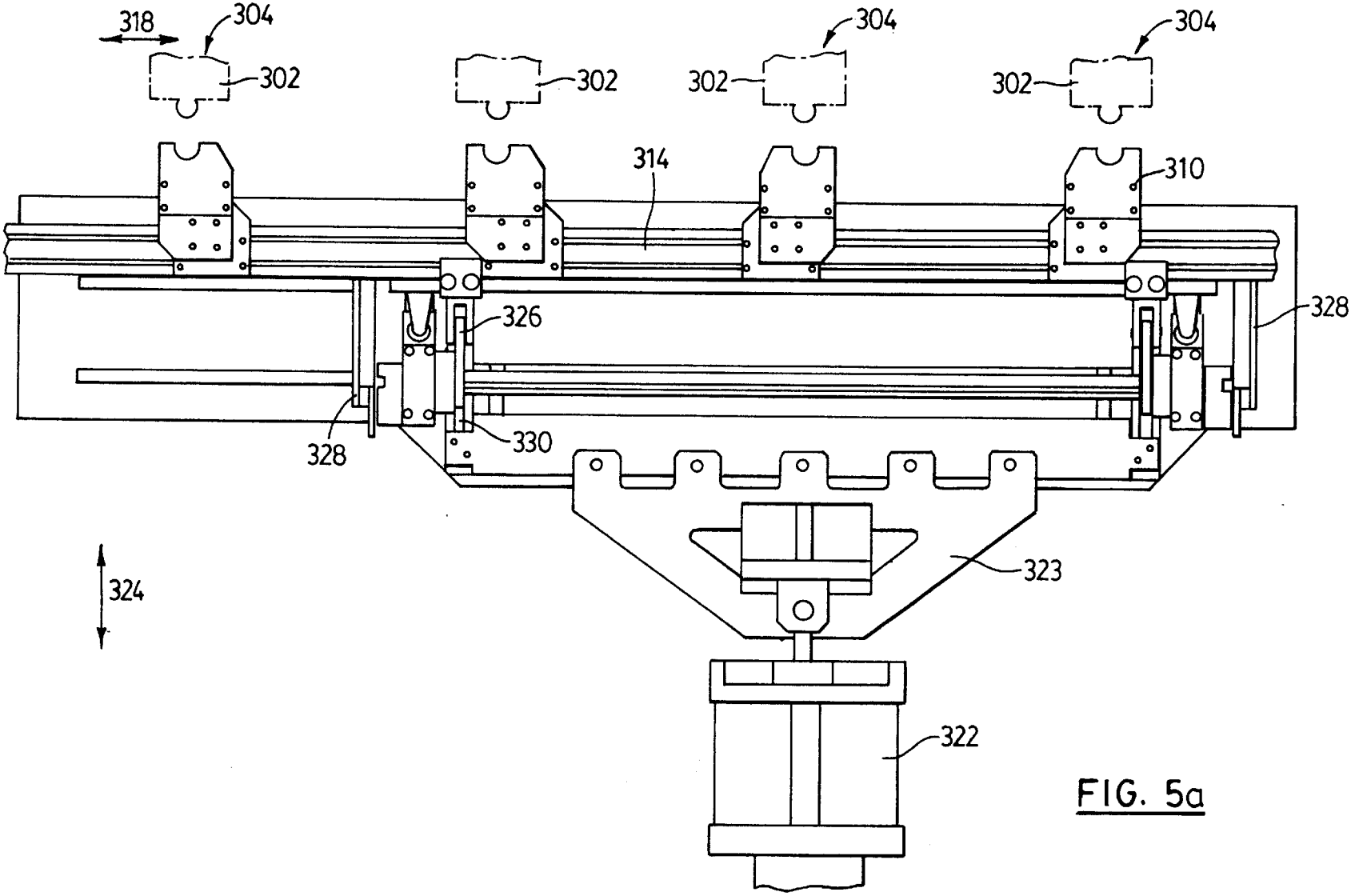
FIGS. 5A–D are plan views of the transfer apparatus illustrated in FIG. 4 showing the successive movement of the transfer press as it moves from the back position (FIG. 5A) and into the workpiece engagement position (FIG. 5B), as it lifts the workpieces above their corresponding die stations (FIG. 5C), and as it moves the workpieces longitudinally to the next in-line die station.
Figure 5B:
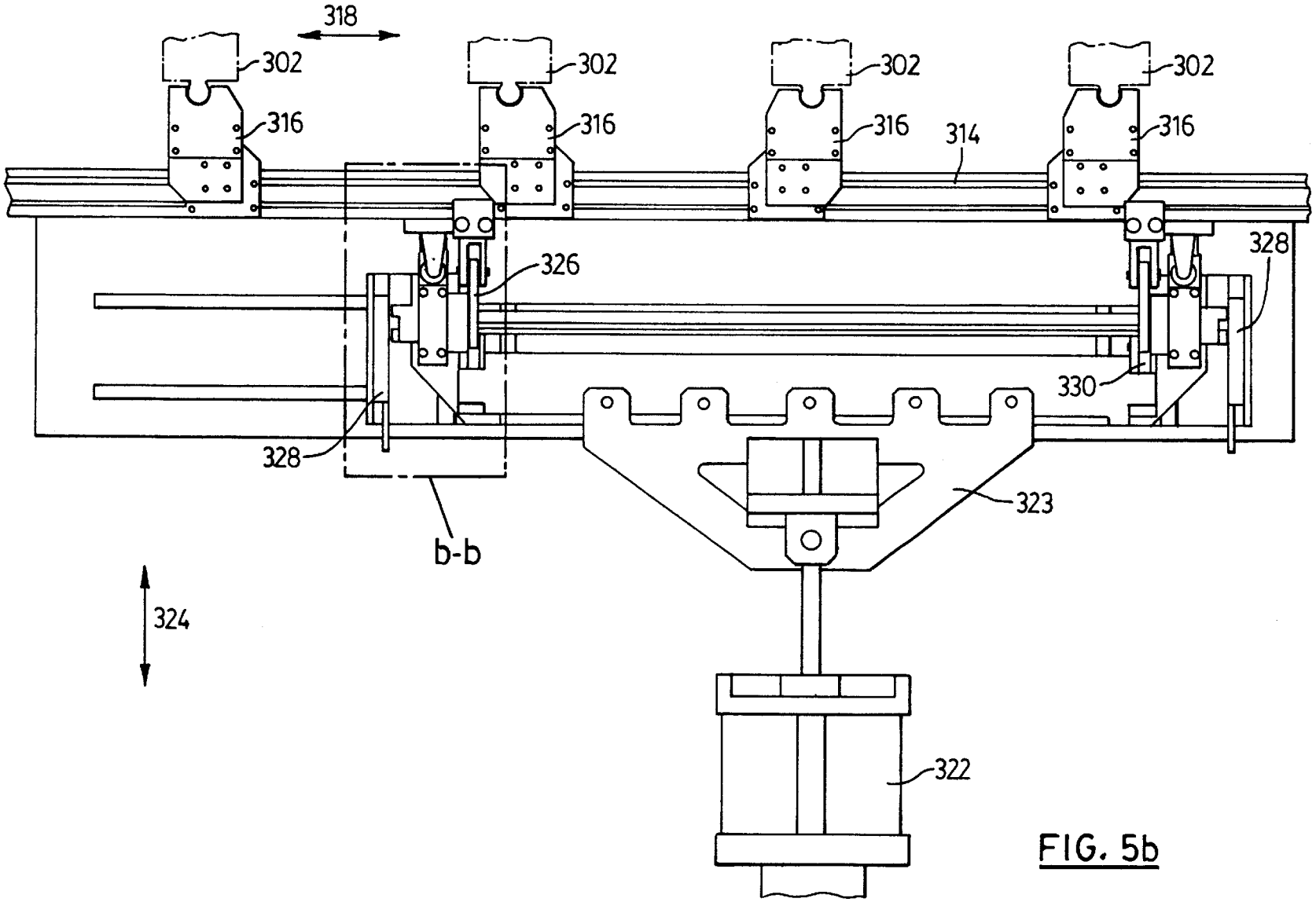
Figure 5C:
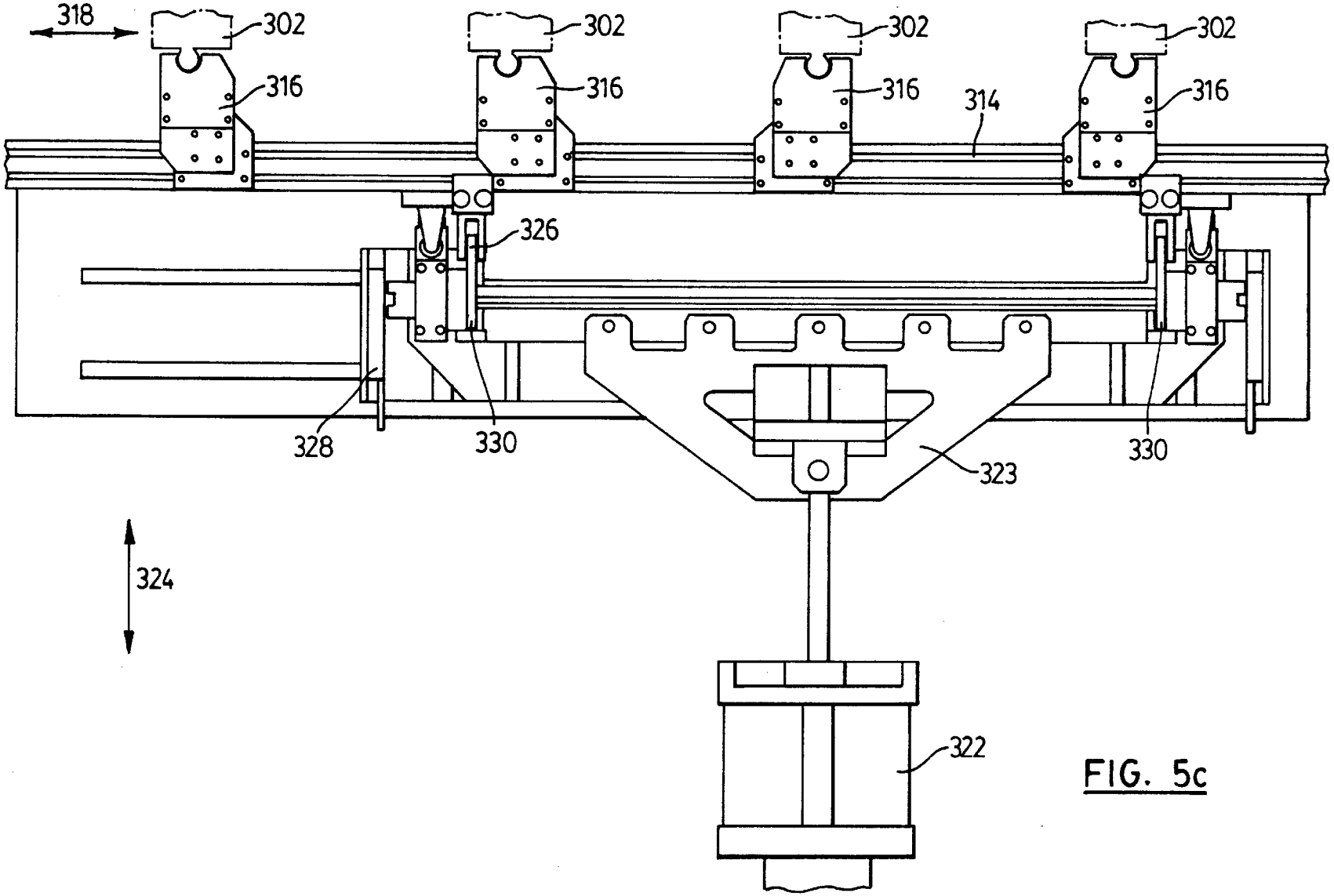
Figure 5D:
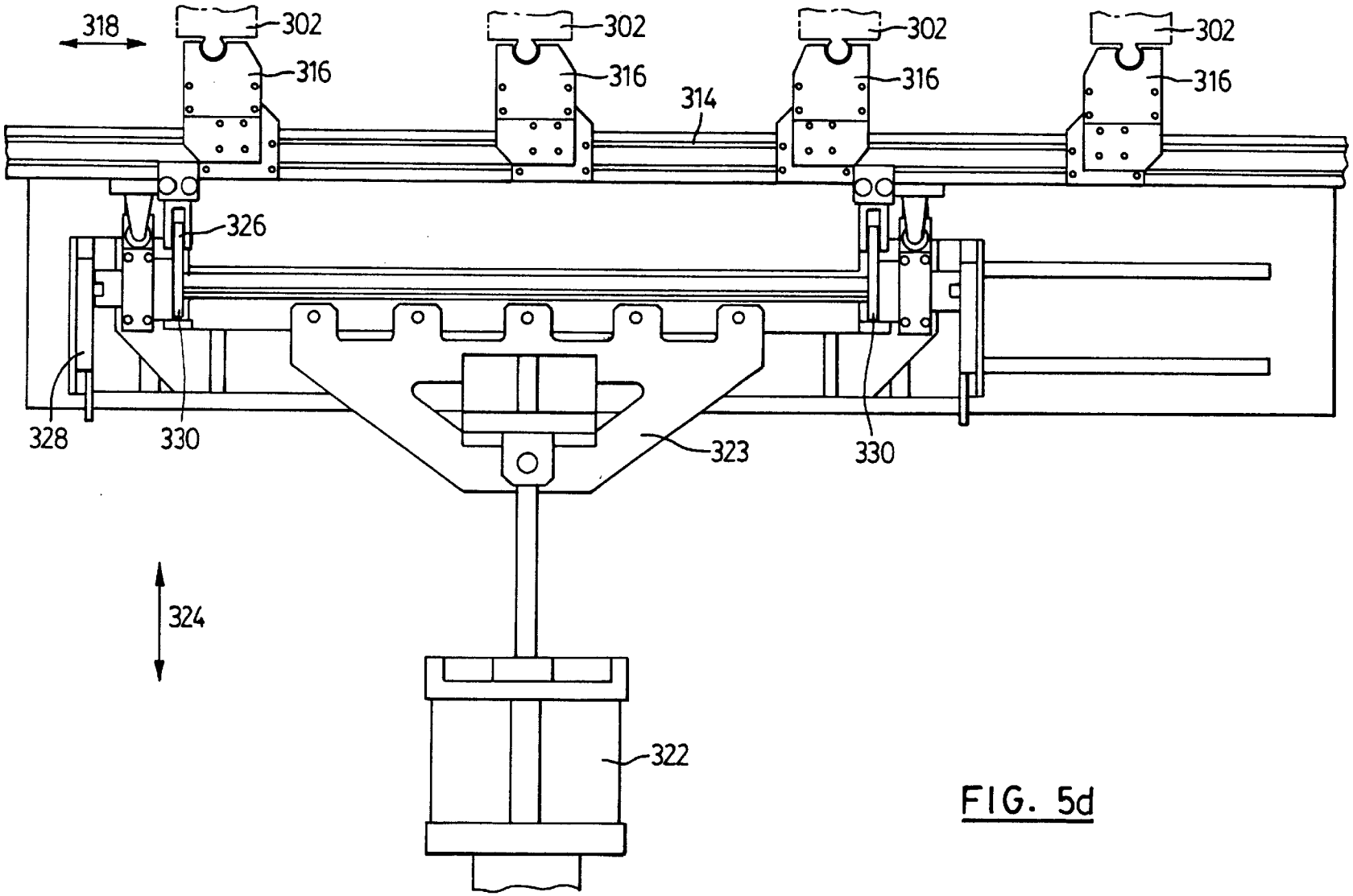
Figure 6:
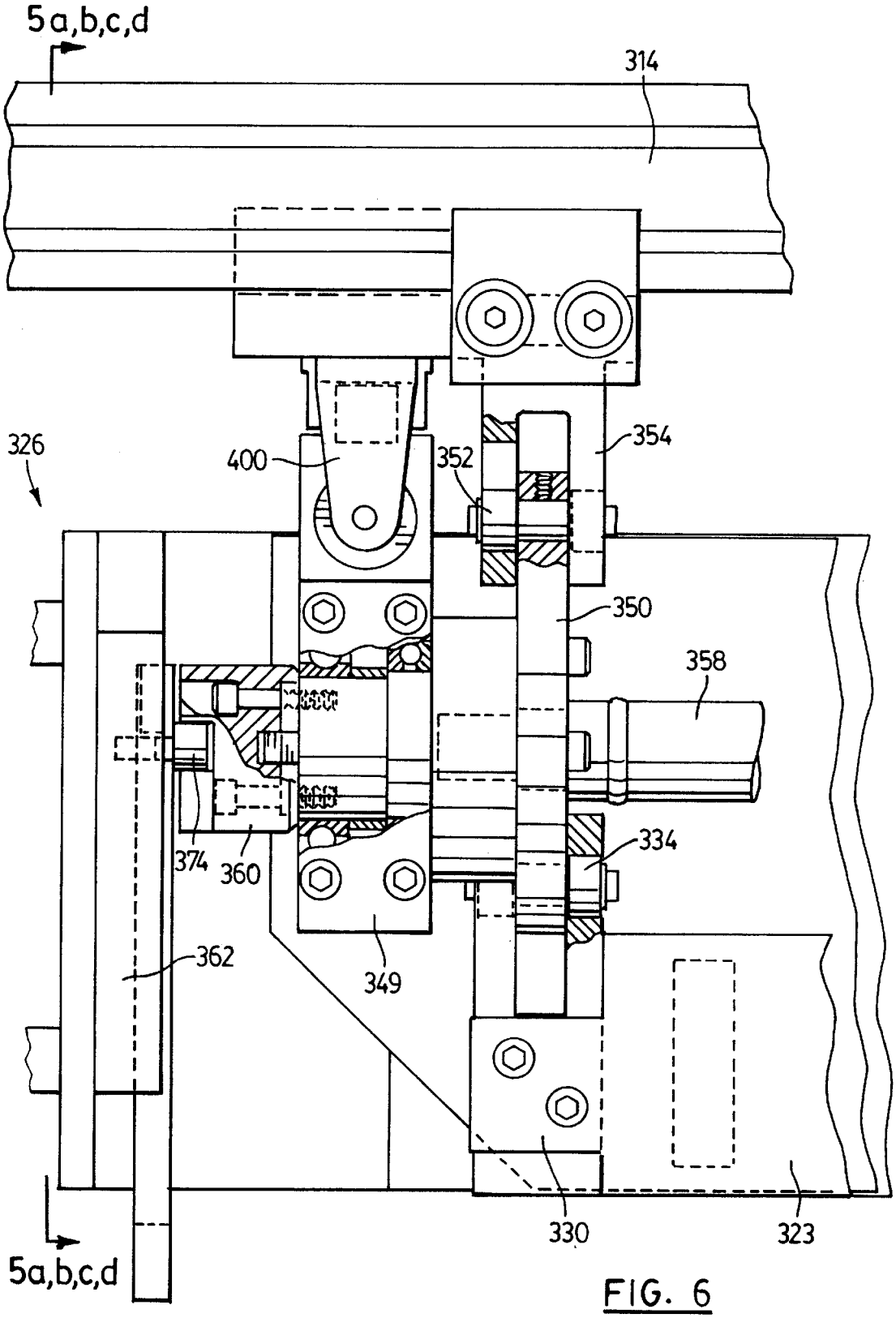
FIG. 6 is a detailed cut-away plan view of the section marked "B—B" on FIG. 5B.

The operation of transfer apparatus 300 will now be described in detail, with reference to the FIGS. 7A–C and 8A–C and successive steps shown in FIGS. 5A–C. Commencing with FIG. 5A, finger bar 314 is shown in a laterally retracted position from the workpiece, prior to robot motive means 322 imparting horizontal lateral forces to the pusher plate 323 of drive module 320 in the forward direction denoted by directional arrow "X" (FIG. 5A). Second end 353 of lifter arm 350 is disposed along a first vertical plane (FIG. 7A). Further, first cam follower 370 of control arm 360 is disposed within the first segment 380 of slot 372 formed in guide plate 362 and, more particularly, at the first end 376 of slot 372 (FIG. 8A).

Upon robot motive means 322 urging pusher plate 323 in a laterally forward direction, pusher arm 330 moves along linear bearing 338 and carries lifter arm 360 and finger bar 314, all in a laterally forward direction (FIG. 8B). Simultaneously, first cam follower 370 of control arm 360 begins travelling within first slot segment 380 in a laterally forward direction. Because first slot segment 380 is characterized by a horizontally linear geometry, travel of first cam follower 370 within first slot segment 380 is maintained along a horizontal plane. Because lifter arm 350 is coupled to control arm 360 and its first cam follower 370 by shaft 358, so long as first cam follower 370 is disposed within first slot segment 380, travel of second end 353 of lifter arm 350 and, therefore, finger bar 314 is maintained along a fixed vertical plane.

As pusher plate 323 and pusher arm 330 are further urged in a laterally forward direction by robot motive means 322, first cam follower 370 approaches second slot segment 382 (FIG. 8A–A). Simultaneously, finger bar 314 moves towards a workpiece engagement position, whereby fingers 316 engage workpieces 302 provided at associated die stations 304 (See FIG. 5B). As of this time, lifter arm 350 has travelled laterally along a substantially fixed horizontal plane, with substantially no vertical component to that motion (FIG. 7A–A).

As pusher plate 323 is even further urged in a laterally forward direction, first cam follower 370 enters second slot segment 382 (FIGS. 7B and 8B). Simultaneous with this event, guide pin 374 engages arcuate sidewall segment 396 of control arm 360, interfering with laterally forward motion of control arm 360, and, more importantly, substantially fixing the axis of rotation of control arm 360. Because finger bar 314 is coupled to lifter arm 350, which is connected to control arm 360 by shaft 358, any further laterally forward motion of finger bar 314 is prevented by virtue of engagement of guide pin 374 with control arm 360.

While first cam follower 370 is travelling within second slot segment 382 and is disposed remote from second end 378 (FIG. 8B–B), pusher plate 323 is free to move in a laterally forward direction upon further urging by robot motive means 322. Therefore, as robot motive means 322 continues to urge pusher plate 323 in a laterally forward direction, pusher arm 330 continues to move in a laterally forward direction along linear bearing 338 until first cam follower 370 reaches second end 378 of slot 372. During this time, laterally forward motion of pusher arm 330 causes lifter arm 350 to rotate with shaft 358 and control arm 360 in a clockwise manner (FIG. 7B–B). Such rotation causes upwards vertical displacement of second end 353 of lifter arm 350 as well as finger bar 314 which is coupled to second end 353. As such, workpieces 302 engaged by finger bar 314 are lifted above their corresponding die stations 304. Simultaneously, arcuate sidewall segment 396 rotates with control arm in a clockwise direction about guide pin 374, while remaining in continuous contact with guide pin 374. In this respect, guide pin 374 presents an opposing reactionary force to the horizontal force applied by arcuate sidewall segment 396, thereby substantially fixing the axis of rotation of control arm 360, and substantially preventing forward lateral movement of finger bar 314 during upwards vertical displacement thereof.

Simultaneous with travel of first cam follower 370 within second slot segment 382 in a forwardly direction, air cylinder 404 is actuated to assist lifter arm 350 in raising finger bar 314. In this respect, air cylinder 404 is actuated upwardly.

Laterally forward motion of pusher arm 330 is terminated when first cam follower 370 reaches second end 378 of slot 372 (See FIG. 8C). Simultaneously, shaft 358 becomes disposed in abutting contact with stop 398, thereby limiting further laterally forward movement of pusher arm 330 (See FIG. 5C), causing cessation of rotation of lifter arm 350 (See FIG. 7C). As a necessary result of these events, upwardly vertical movement of finger bar 314 is also terminated. At this point, workpieces 302 have been lifted above the die stations 304.

Once the workpieces 302 are lifted above the die stations 304, and forward movement of pusher plate 323 is prevented, robot motive means 322 ceases lateral travel in the forward direction and commences longitudinal motion. Longitudinal motion of robot motive means causes pusher plate 323, along with finger bar 314 and the engaged workpieces 302 to move longitudinally along the die station 304 a predetermined distance. Such predetermined distance being equal to the distance between successive die stations 304.

Once the workpieces 302 are situate above their next respective die stations 304, longitudinal movement of robot motive means 322 ceases, and the robot motive means 322 begins imparting horizontal forces to the pusher plate 323 in the laterally rearward direction to cause lowering of the finger bar 314. At this time, first cam follower 370 begins travelling rearwardly within second slot segment 382, causing counterclockwise rotation of control arm 360 and vertical descent of finger bar 314. Further, air cylinder 404 is depressurized, resulting in downward vertical motion within finger bar 314. This causes lowering of workpieces 302 onto the die stations 304. Simultaneously, arcuate sidewall segment 396 rotates with control arm 360 in a counterclockwise direction about guide pin 374, while continuously maintaining contact with guide pin 374 during the entire rearward travel of first cam follower 370 within second slot segment 382. In this respect, guide pin 374 provides an opposing force to rearward horizontal forces applied by arcuate sidewall segment 396, thereby substantially preventing lateral movement in the rearward direction of finger bar 314 while finger bar 314 is descending.

Once the workpieces 302 are lowered onto their new die stations 304, first cam follower 370 enters first slot segment 380, and further vertical displacement of finger bar 314 is prevented. Simultaneously, arcuate sidewall segment 396 of control arm 360 disengages from guide pin 374, permitting control arm 360, shaft 358, lifter arm 350, and finger bar 314 to move laterally in a rearward direction with pusher arm 330 and upon further urging of pusher plate 323 by robot motive means 322. As finger bar 314 begins to move rearwardly, fingers 316 disengage from workpieces 302 and the finger bar 314 becomes retracted from a workpiece engagement position.

As finger bar 314 becomes retracted, and first cam follower 370 becomes disposed in first slot segment 380, robot motive means 322, through pusher plate 323, pusher arm 330 and lifter arm 350 continues to urge finger bar 314 laterally in a rearward direction. As first cam follower becomes disposed against first end 376 of slot 372, finger bar 314 assumes the fully retracted position. Simultaneously, robot motive means 322 ceases lateral travel in the rearward direction, and commences longitudinal travel, opposite in direction to the longitudinal motion above-described when the workpieces 302 were indexed to successive die stations 304, returning to the initial starting position. As a result, fingers 316 on finger bar 314 return to their corresponding positions of their original die stations 304.

Although the disclosure describes and illustrated preferred embodiments of the invention, it is to be understood that the invention is not limited to these particular embodiments. Many variations and modifications will now occur to those skilled in the art. For definition of the invention, reference is to be made to the appended claims.

I claim:

1. An apparatus for transferring workpieces between successive die stations in a stamping press, including an elongated bar having a plurality of spaced workpiece engaging means for engaging workpieces at successive die stations, comprising:

motive means;

a drive frame member coupled to said motive means and laterally and longitudinally propelled by said motive means;

cam follower means propelled by said drive member;

cam plate means, coupled to a bar member, having a first cam slot means and a second cam slot means, said first cam slot means receiving said cam follower means, said cam plate means propelled both horizontally and vertically by said cam follower means;

cam stop means disposed in said second cam slot means to prevent said cam plate means from motion in the horizontal direction during motion in the vertical direction and to prevent said cam plate means from motion in the vertical direction during motion in the horizontal direction; and motion transmitting means coupled to said drive frame member and disposed adjacent to said cam plate means, said motion transmitting means driving said cam plate means longitudinally when propelled by said drive frame member.

2. The apparatus of claim 1 wherein said first cam slot means is vertically inclined.

3. The apparatus of claim 2 wherein said cam stop means further comprises a cam stop follower which is received by said second slot means.

4. The apparatus of claim 3 wherein said second slot means further includes a substantially horizontal slot portion and a substantially vertical slot portion disposed in substantially orthogonal relationship to each other and each interconnected at a distal end thereof.

5. The apparatus of claim 4 wherein said motive means is a robot capable of movement in three dimensions.

6. The apparatus of claim 5, wherein said cam stop means comprising a pair of longitudinally spaced apart cam stop members supported on a linear bearing for providing guided longitudinal movement thereof.

7. An apparatus for transferring workpieces in a stamping press, including an elongated bar having a plurality of spaced apart workpiece engaging means for engaging workpieces at successive die stations, comprising:

motive means;

a drive frame member coupled to said motive means and laterally and longitudinally propelled by said motive means;

a first cam follower and a second cam follower, each propelled by said drive frame member;

a first cam plate and a second cam plate, each of said cam plates coupled to a bar member in spaced apart relationship and having a first cam slot means and a second cam slot means, said first cam slot means of said first cam plate receiving said first cam follower for driving said first cam plate horizontally and vertically with respect to the die stations and said first cam slot means of said second cam plate receiving said second cam follower for driving said second cam plate horizontally and vertically with respect to the die stations;

a first cam stop and a second cam stop, said first cam stop disposed in said second cam slot of said first cam plate and said second cam stop disposed in said second slot of said second cam plate, for preventing each of said first cam plate and said second cam plate from motion in a horizontal direction during motion of the drive frame member in a vertical direction and for preventing said first cam plate and said second cam plate from motion in the vertical direction during motion in the horizontal direction; and a first motion transmitting plate and a second motion transmitting plate, each coupled to said drive frame member, said first motion transmitting plate disposed adjacent to an inner surface of said first cam plate and said second motion transmitting plate disposed adjacent to an inner surface of said second cam plate, for driving each of said first cam plate and said second cam plate longitudinally when propelled by said drive frame member.

8. The apparatus of claim 7 wherein said first cam slot is vertically inclined.

9. The apparatus of claim 8 wherein said cam stop further comprises a cam stop follower which is received by said second cam slot.

10. The apparatus of claim 9 wherein said second cam slot further includes a substantially horizontal first slot portion and a substantially vertical second portion, disposed in substantially orthogonal relationship to each other, and an arcuate portion interconnecting said first and second slot portions.

11. The apparatus of claim 10 wherein said motive means is a robot capable of movement in three dimensions.

12. The apparatus of claim 11, further comprising assist means for providing aid in overcoming a portion of the force required to move said cam plate means vertically.

13. The apparatus of claim 12, further comprising an elongated rail, said elongated rail slidably engaging each of said first and second cam stops for providing guided longitudinal movement thereof.

14. An apparatus for attachment to a robot for transferring workpieces in a multi-station stamping press, comprising:

an elongated bar having a plurality of spaced apart workpiece engaging means for engaging workpieces at successive die stations, a drive frame member coupled to the robot and propelled laterally and longitudinally by the robot;

a first cam follower and a second cam follower, each propelled by said drive frame member;

a first cam plate and a second cam plate, each of said cam plates coupled to the bar in spaced apart relationship and having a first cam slot means and a second cam slot means, said first cam slot means of said first cam plate receiving said first cam follower for driving said first cam plate horizontally and vertically and said first cam slot means of said second cam plate receiving said second cam follower for driving said second cam plate horizontally and vertically;

a first cam stop and a second cam stop, said first cam stop disposed in said second cam slot of said first cam plate and said second cam stop disposed in said second slot of said second cam plate, for preventing each of said first cam plate and said second cam plate from motion in the horizontal direction during motion in the vertical direction and for preventing said first cam plate and said second cam plate from motion in the vertical direction during motion in the horizontal direction; and a first motion transmitting plate and a second motion transmitting plate, each coupled to said drive frame member, said first motion transmitting plate disposed adjacent to an inner surface of said first cam plate and said second motion transmitting plate disposed adjacent to an inner surface of said second cam plate, for driving each of said first cam plate and said second cam plate longitudinally when propelled by said drive frame member.

15. The apparatus of claim 14 wherein said first cam slot is vertically inclined.

16. The apparatus of claim 15 wherein said cam stop further comprises a cam stop follower which is received by said second cam slot.

17. The apparatus of claim 16 wherein said second cam slot further includes a substantially horizontal first slot portion and a substantially vertical second portion, disposed in substantially orthogonal relationship to each other, and an arcuate portion interconnecting said first and second slot portions.

18. The apparatus of claim 17, further comprising assist means for providing aid in overcoming a portion of the force required to move said cam plate means vertically.

19. The apparatus of claim 18, further comprising an elongated rail, said elongated rail slidably engaging each of said first and second cam stops for providing guided longitudinal movement thereof.

20. An apparatus for transferring workpieces between successive die stations in a stamping press, including an elongated bar, the elongated bar including a plurality of spaced workpiece engaging means for engaging workpieces at successive die stations comprising:

a motive means;

a lifter arm including a first arm end and a second arm end, said first arm end pivotally coupled to and propelled by said motive means, said second arm end pivotally coupled to said bar;

a shaft integral with and extending from said lifter arm;

a cam follower connected to said shaft; and a guide plate including a guide slot, the guide slot including a first slot end and a second slot end, wherein said first slot end is vertically disposed above said second slot end;

wherein said cam follower is configured for travel within said guide slot, and wherein such travel causes rotation of said shaft and vertical displacement of said second arm end of said lifter arm.

21. The apparatus as claimed in claim 20 wherein said guide slot further comprises a substantially horizontal slot segment extending from said first slot end, and an arcuate slot segment terminating at said second slot end and characterized by an upwardly facing concave profile, said arcuate slot segment extending from and communicating with said substantially horizontal slot segment, wherein said vertical displacement of said first arm end of said lifter arm occurs during travel of said cam follower within said arcuate slot segment.

22. The apparatus as claimed in claim 21 wherein said first slot end is disposed distally from said bar relative to said second slot end.

23. The apparatus as claimed in claim 22 wherein said arcuate slot segment is characterized by a constant radius of curvature.

24. The apparatus as claimed in claim 23 further comprising:

a control arm extending from said shaft, said cam follower extending from said control arm; and a guide pin;

wherein said guide pin is engaged to said control arm during travel of said cam follower within said arcuate slot segment such that said control arm rotates about a fixed axis as said cam follower travels within said arcuate slot segment.

25. The apparatus as claimed in claim 24 wherein said control arm includes a sidewall providing a horizontally orthogonal surface for continuously engaging said guide pin during Travel of said cam follower within said arcuate slot segment.

26. The apparatus as claimed in claim 25 wherein said sidewall is characterized by an arcuate profile having a radius of curvature substantially similar to that of said arcuate slot segment.

27. The apparatus as claimed in claim 26 wherein said guide pin is integral with and extends from said guide plate.

* * * * *